US006615739B2

(12) United States Patent
Gibson et al.

(10) Patent No.: US 6,615,739 B2
(45) **Date of Patent: *Sep. 9, 2003**

(54) AERODYNAMIC PROJECTILES AND METHODS OF MAKING THE SAME

(75) Inventors: Gary E. Gibson, Riverwoods, IL (US); Michael A. Varacins, Woodstock, IL (US)

(73) Assignee: Perfect Circle Paintball, Inc., Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/826,717

(22) Filed: Apr. 5, 2001

(65) Prior Publication Data

US 2001/0045173 A1 Nov. 29, 2001

Related U.S. Application Data

(63) Continuation-in-part of application No. 09/266,060, filed on Mar. 10, 1999, now Pat. No. 6,230,630.

(51) Int. Cl.[7] ..... F42B 8/00; F42B 8/04

(52) U.S. Cl. ..... 102/513; 102/502; 102/311; 102/529; 102/444

(58) Field of Search ..... 102/513, 511, 102/444, 501, 502, 529, 506; 124/56

(56) References Cited

U.S. PATENT DOCUMENTS

| | | | | |
|---|---|---|---|---|
| 39,942 A | | 9/1863 | McMurtry | |
| 1,088,025 A | | 2/1914 | Johnson | |
| 1,285,599 A | | 11/1918 | Bennett | |
| 2,105,528 A | | 1/1938 | Foisy | |
| 2,172,054 A | | 9/1939 | Di Brazza-Savorgnan | |
| D138,288 S | | 7/1944 | LaClair | |
| 2,925,276 A | | 2/1960 | Leclerc | |
| 3,037,454 A | | 6/1962 | Young | |
| 3,649,020 A | | 3/1972 | Hall | |
| 3,650,213 A | * | 3/1972 | Abbott et al. | 102/436 |
| 3,782,286 A | | 1/1974 | Jones et al. | |
| 3,791,303 A | | 2/1974 | Sweeney et al. | |
| 3,952,662 A | | 4/1976 | Greenlees | |
| 4,128,059 A | | 12/1978 | Black | |
| 4,428,295 A | | 1/1984 | Urs | |
| 4,634,606 A | * | 1/1987 | Skogg | 102/513 |
| 4,656,092 A | * | 4/1987 | Haman et al. | 102/513 |
| 4,684,137 A | | 8/1987 | Armer, Jr. et al. | |
| 4,779,535 A | | 10/1988 | Maki | |
| 4,813,635 A | | 3/1989 | Paterson et al. | |
| 4,823,702 A | | 4/1989 | Woolsey | |
| 4,895,076 A | | 1/1990 | Looger et al. | |
| 4,899,660 A | * | 2/1990 | Brighton | 102/513 |
| 4,932,329 A | | 6/1990 | Logie | |
| 4,942,818 A | | 7/1990 | Saxby | |
| 4,944,521 A | | 7/1990 | Greeno | |
| 4,950,516 A | | 8/1990 | Schwab | |
| 5,001,880 A | | 3/1991 | Smith | |
| 5,009,164 A | | 4/1991 | Grinberg | |
| 5,009,165 A | | 4/1991 | Morris | |
| 5,018,449 A | | 5/1991 | Eidson, II | |
| 5,018,450 A | * | 5/1991 | Smith | 102/513 |
| 5,035,183 A | | 7/1991 | Luxton | |
| 5,121,692 A | | 6/1992 | DiCarlo | |
| 5,254,379 A | | 10/1993 | Kotsiopoulos et al. | |

(List continued on next page.)

FOREIGN PATENT DOCUMENTS

| | | | | |
|---|---|---|---|---|
| DE | 41 35 466 A1 | * | 4/1993 | 102/501 |
| SE | WO 94/25817 | * | 11/1994 | 102/501 |

*Primary Examiner*—Michael J. Carone
*Assistant Examiner*—Lulit Semunegus
(74) *Attorney, Agent, or Firm*—Leydig, Voit & Mayer, Ltd.

(57) ABSTRACT

The invention provides aerodynamic projectiles that include a projectile shell having an aerodynamic structure and a controlled center of gravity, which exhibit improved aerodynamics and resulting accuracy, and which are suitable for non-lethal uses. Methods of making such aerodynamic projectiles also are provided.

30 Claims, 11 Drawing Sheets

U.S. PATENT DOCUMENTS 5,279,787 A 1/1994 Oltrogge
D348,907 S 7/1994 Prentice et al.
5,353,712 A * 10/1994 Olson ..... 102/513
5,393,054 A 2/1995 Rouffer
5,443,010 A * 8/1995 Dahlitz ..... 102/511
5,448,951 A * 9/1995 Olson ..... 102/513
5,559,304 A 9/1996 Schweiger et al.
5,565,649 A 10/1996 Tougeron et al.
5,639,526 A * 6/1997 Kotsiopoulos et al. ..... 102/513
5,640,945 A 6/1997 Slonaker et al.
5,654,524 A 8/1997 Saxby
5,936,190 A * 8/1999 Buzick ..... 102/513
5,962,806 A 10/1999 Coakley et al.
5,965,839 A * 10/1999 Vasel et al. ..... 102/502
6,082,349 A 7/2000 Cheng et al.
6,145,441 A * 11/2000 Woodall et al. ..... 102/513
6,223,658 B1 * 5/2001 Rosa et al. ..... 102/513
6,230,630 B1 * 5/2001 Gibson et al. ..... 102/513
6,298,841 B1 * 10/2001 Cheng et al. ..... 124/56

* cited by examiner

AERODYNAMIC PROJECTILES AND METHODS OF MAKING THE SAME

CROSS-REFERENCE TO RELATED PATENT APPLICATIONS

This patent application is a continuation-in-part of copending U.S. patent application Ser. No. 09/266,060, filed Mar. 10, 1999 now U.S. Pat. No. 6,230,630.

FIELD OF THE INVENTION

The invention relates to aerodynamic projectiles and methods for forming the same that are typically fired by compressed gas guns. More particularly, the invention relates to projectiles having an aerodynamic structure and a controlled center of gravity that exhibit improved aerodynamics and resulting accuracy. Preferably, the projectile is a non-lethal projectile.

BACKGROUND OF THE INVENTION

Compressed gas guns, which fire non-lethal projectiles known as paint balls, are typically used to mark individuals for future identification without causing injury. Such non-lethal projectiles are used by sportsmen, police, military and other security forces to mark targeted persons participating in mock war games and other training exercises. While these paint balls may also be used during riots as a means of crowd control or in any other situation that mandates a "less than lethal" attack or defense strategy, they provide little deterrence other than marking the targeted individual with paint.

Traditionally, non-lethal projectiles developed for the purpose of riot control have mainly consisted of rubber bullets that often penetrate the skin causing severe injury to the target. Such rubber bullets have often caused much more severe injury than intended. Further, where no injury occurs, the targeted individual may escape identification.

Recently, paint ball projectiles made of a plastic, such as polystyrene, were developed to fracture in a predetermined pattern upon impact with a target. U.S. Pat. Nos. 5,254,379 and 5,639,526 (the disclosures of which are incorporated herein in their entirety) provide a plastic paint ball constructed of a linear polymer of sufficient strength to transport, load, and fire out of a compressed gas gun, which is molecularly oriented such that, upon application of a force at any impact point on the paint ball shell, the shell fractures in a way that greatly reduces the risk of injury. Further, because the plastic paint ball is not water soluble like a gelatinous one, it is not sensitive to the environment and can be filled with a wide variety of components, including aqueous dyes, powders and solids.

While such plastic paint balls effectively mark a target without injury, they do not adequately stun or immobilize a target, as is needed for the purpose of riot control. Further, traditional paint balls, whether the shell is formed from gelatin or plastic, suffer from inaccuracy, especially when launched from a distance greater than 100 feet from the target. This inaccuracy is due, in part, to the spherical shape and smooth surface of the paint ball projectile. The spherical shape creates an irregular, turbulent flow around the projectile causing an unstable flight pattern. Also, when a smooth-surfaced paint ball is fired from a smooth-bore, uniform barrel, the result is a ball generally without spin, which behaves unpredictably. Additionally, due to inherent manufacturing difficulties, most paint ball projectiles are not perfectly spherical. For example, gelatinous paint balls tend to be at least 0.015" out of round. While plastic shells are usually only about 0.002" out of round, even this seemingly small oblong shape imparts inaccuracy to the fired paint ball projectile.

Another problem is that the effective range of current paint ball projectiles is very limited. This is because paint balls are typically large projectiles, are not very dense, and are fired at low muzzle velocities, all of which creates a substantial amount of drag in comparison to the momentum provided to the paint ball upon firing with a compressed gas gun.

Thus, there remains a need for a projectile that is effective in marking and stunning, or otherwise immobilizing, a target. Preferably marking occurs without causing serious injury or death to the target. There remains a further need to produce such a projectile that has increased accuracy and range when used with the launching power of compressed gas guns.

BRIEF SUMMARY OF THE INVENTION

The present invention provides an improved projectile that overcomes the deficiencies of the prior art and is useful for the purpose of riot control. The present invention preferably provides a non-lethal projectile which shell fractures upon impact and has sufficient mass to stun or otherwise immobilize the target and/or mark the target preferably without killing or seriously injuring the target.

A projectile shell of a first embodiment of the present invention comprises a generally hemispherical portion and a generally cylindrical portion. The hemispherical portion has a wall with an inner surface and an outer surface wherein the inner surface forms a hemispheric interior volume. The cylindrical portion also has a wall with an inner surface and an outer surface and the inner surface forms a hemispheric interior volume having the same general shape and volume as the interior volume of the hemispherical portion. The hemispherical portion is joined to the cylindrical portion at a rim. Preferably, the cylindrical portion has a length that is at least about equal to one-half the diameter of the hemispherical portion.

The hemispherical portion can assume any suitable hemispherical shape. Preferably, the hemispherical portion is curved throughout, rather than including a straight portion connected to a curved ending.

In a second embodiment of the present invention, a projectile shell is provided which comprises a generally hemispherical portion and a frustum portion. The hemispherical portion has a wall with an inner surface and an outer surface wherein the inner surface forms a hemispheric interior volume. The frustum portion also has a wall having an inner surface and an outer surface. The inner surface forms an interior volume having the same general shape and volume as the interior volume of the hemispherical portion. The frustum has a diameter at its wide end which is about equal to the diameter of the hemispherical portion and a length which is at least about equal to one-half of that diameter. The hemispherical portion is joined to the wide end of the frustum portion at a rim.

Preferably, the projectile shell of the second embodiment of the present invention is formed from a linear polymer such as polystyrene which is molecularly oriented along circumferential lines in the hemispherical portion extending from the apex of the hemispherical portion toward the frustum portion. In one embodiment of the second embodiment of the present invention, the projectile shell hemispherical portion has a wall thickness of from about 0.005 inches to about 0.040 inches. Preferably, the wall thickness at or near the rim is greater than the wall thickness at the apex of the hemispherical portion. The frustum portion has a wall thickness of from about 0.025 inches to about 0.050 inches measured at or near the rim where the frustum portion is joined to the hemispherical portion.

The projectile shell of the second embodiment of the present invention may also further comprise a circular insert having a first wall facing the interior volume of the hemispherical portion and a second wall facing the interior volume of the frustum portion. The circular insert is placed between the hemispherical and frustum portions prior to joining the hemispherical portion to the frustum portion. The circular insert effectively isolates the interior volume of the hemispherical portion from the interior volume of the frustum portion. Preferably, the circular insert has a thickness of from about 0.010 inches to about 0.040 inches and a diameter of from about 0.620 inches to about 0.635 inches.

Preferably, the frustum portion includes at least four fins spaced equal distances apart on its exterior surface. More preferably, the frustum portion includes sixteen fins spaced equal distances apart on its exterior surface. Even more preferably is that each of the fins curves around the exterior surface about 0.0708 revolutions per inch of fin length.

The projectile can further include one or more indentations, depressions, or scoring to promote rupture. In such projectiles, the indentations or scoring can be arranged in any suitable configuration. For example, a single indentation can be used to promote fracture along a certain line upon impact (alternatively, an area of the area of desired fracture can be formed weaker than other portions of the projectile, or weakened after manufacture). Alternatively, a plurality of indentations or scoring can be used to promote a pattern of fractures in a specific region. Preferably, the projectile of the invention lacks any central dimple, indentation, or depressed region, thereby promoting a larger range of dispersion of the contents of the hemispherical portion upon contact. Typically and preferably, the projectile includes no indentations, scoring, or depressions on the hemispherical, cylindrical portion (or, if applicable, frustum portion), or both portions, as such dispersion-promoting features are not critical to the functionality of the projectiles of the invention. The projectiles of the invention can further include dimples that promote the accuracy and/or distance of the projectile. In such aspects, the dimples can either promote accuracy and distance without promoting fracture of the projectile at locations where dimples are present, or, alternatively, can also promote fracture at those locations. Dimples can be connected by drag enhancing airflow channels. The dimples can be arranged in any suitable pattern, such as a simple triangular pattern, or a pattern based upon multiple triangles, in bands arranged about the particular surface, or an asymmetrical pattern. The dimples can be of any suitable shape, such as various types of triangles, hexagons, ovals, crescents, ellipses, tetrahedrons, tear drops, concentric rings, and sickle shapes. The dimples may be contoured. A mixture of dimples with various shapes also can be used, for example, a central groove of larger oval dimples can be surrounded by evenly displaced circular dimples to improve distance by promoting air turbulence around the projectile or a pattern formed by intersecting dimples of various shapes can be used. The dimples can be of any suitable size, and can include mixtures of small and large dimples. The dimples can be of any suitable depth. Generally, increased depth is associated with greater drag. Mixtures of elevated dimpled structures and dimples formed in the horizontal portion or cylindrical/frustum portion surface also can be used.

The present invention further relates to a projectile comprising a shell having a hemispherical portion and a cylindrical portion shell. The shell's hemispherical portion has an inner surface and an outer surface forming a wall and a hemispheric interior volume. The cylindrical portion also has an inner surface and an outer surface which forms a wall and the inner surface forms a hemispheric interior volume having the same general shape and volume as the interior volume of the hemispherical portion. The cylindrical portion also has a length which is at least about equal to one-half the diameter of the hemispherical portion. The hemispherical portion is joined to the cylindrical portion at a rim.

The projectile of the present invention further includes a marking component for marking a target struck by the projectile, which thereby permits identification of the target. The marking component can be located within the hemispherical portion, cylindrical portion, or both portions. Typically, the marking component will preferably be located at least within the interior volume of the hemispherical portion.

Any suitable marking component can be used. Examples of suitable marking components include liquid dyes, powder dyes, water soluble dyes, permanent dyes, infra red dyes, ultra violet dyes, dyes that glows in the dark (e.g., a chemiluminescent dye or a phosphorescent dye), and miniature radiotransmitters.

The projectile of the present invention also or alternatively can include an immobilizing component, which immobilizes a target struck by the projectile. Any suitable immobilizing component can be used. Examples of suitable immobilizing components include liquid irritants, powder irritants, gaseous irritants, pepper powders, tear gas, malodorants, and other noxious chemicals. The immobilizing component can be located within the interior volume of the cylindrical portion, hemispherical portion, or both (preferably at least in the hemispherical portion).

The projectile can include a combination of an immobilizing component and a marking component. Such combinations can include a mixture of the agents (e.g., a mixture of one or more immobilizing agents and one or more marking agents inserted in the hemispherical portion, cylindrical portion, or both portions) or one agent can be incorporated into the cylindrical portion or frustum portion and the other into the hemispherical portion. A preferred combination includes a weighting agent immobilizing component (which typically and preferably is composed of bismuth, lead, or tungsten carbide) deposited in the hemispherical portion interior volume and a marking agent (e.g., a fluorescent or chemiluminescent dye), deposited in the cylindrical portion interior volume, where such interior volumes are separated by a circular insert.

Preferably, the projectile includes a weighting agent. The weighting agent can be any suitable weighting agent. Preferably, the weighting agent includes or consists essentially of a metal or metal alloy that exhibits a Mohs hardness of about 1.5 to about 9.5 and a density of at least about 7.5 g/cc (preferably about 9 g/cc to about 19 g/cc, more preferably about 9.5 g/cc to about 15 g/cc). The metal weighting agent is preferably non-toxic and not environmentally hazardous (e.g., non-copper metal weighting agents are preferred). Examples of suitable weighting agents include bismuth, lead, and tungsten carbide (preferably, tungsten carbide sintered with cobalt or nickel). Alloys of such agents and similar metals (such as and similar to those described in U.S. Pat. Nos. 4,949,644 and 5,279,787) and mixtures of such agents also are contemplated. Preferably, the weighting agent is composed of at least about 70%, more preferably at least about 80%, and even more preferably at least about 90% (optimally about 100%) lead, Bismuth, tungsten carbide, or combination thereof. Bismuth weighting agents are non-toxic, pose low risks to the environment, and may be preferred where such considerations are important. Any suitable amount of weighting agent can be used. Preferably, the weighting agent is present in an amount of about 2–15 grams. The weighting agent can be associated with the marking component or immobilizing component (for example, in aiding the trajectory and targeting of the projectile), or, if present in suitable quantity, can act as an immobilizing component. The weighting agent can be incorporated in the hemispherical portion, cylindrical portion, or both portions. The weighting agent can be mixed with a marking component or immobilizing component in one of the portions, or be separately incorporated into one of the portions.

A projectile of the present invention is further provided in a second embodiment that comprises a shell having a generally hemispherical portion and a frustum portion. The hemispherical portion has an inner surface and an outer surface forming a wall and a hemispheric interior volume. The frustum portion also has an inner surface and an outer surface that forms a wall and the inner surface forms a hemispheric interior volume having the same general shape and volume as the interior volume of the hemispherical portion. The frustum portion has a diameter at its wide end which is about equal to the diameter of the hemispherical portion and a length which is at least about equal to one-half that diameter. The hemispherical portion is joined to the wide end of the frustum portion at a rim. The projectile further includes a marking composition for marking a target struck by the projectile to permit identification of the target. The marking component is preferably located at least within the hemispherical portion interior volume (i.e., within the hemispherical portion only, or both portions). Alternatively, the marking component can be located only in the cylindrical portion.

Preferably, the projectiles of the present invention include at least four fins spaced equal distances apart on the exterior surface of either the cylindrical portion or the frustum portion and more preferably sixteen fins are used. Even more preferably is that each of the fins curves around the exterior surface about 0.0708 revolutions per inch of fin length. Also preferably, the cylindrical portion or the frustum portion has a length greater than one-half of the diameter of the hemispherical portion.

Further provided is a method producing the projectile of the present invention comprising injecting a linear polymer into a first mold to form a hemispherical portion shell having a hemispheric inner wall, a hemispheric outer wall, a hemispherically shaped interior volume, and a fill port, where the inner and outer walls also form a rim. Further, a linear polymer is injected into a second mold forming a cylindrical portion shell having a hemispheric inner wall, a cylindrical outer wall, an interior volume, and a fill port. The cylindrical portion inner and outer walls form a rim having a profile suitable for mating with the rim formed in the hemispherical portion. Preferably, a circular insert is also molded. Desirably, a suitable weighting agent is placed within the hemispherical shell, the circular insert is then placed between the hemispherical portion and the cylindrical portion, and the hemispherical portion and the cylindrical portion are joined together about their rims, trapping the circular insert in place and sealing and isolating the interior volumes of the hemispherical portion and cylindrical portion from one another. Preferably, any liquid, such as a dye, for marking a target struck by the projectile is then dispensed into the hemispherical portion using its fill port, the cylindrical portion using its fill port, or both, and the fill port or fill ports, as applicable, are then sealed. More preferably, water and/or other liquid marking compositions are dispensed into the interior volume of the cylindrical portion using its fill hole. Again, the fill hole is sealed. Finally, any flashing is preferably removed.

Also provided is a method producing a second embodiment of the projectile of the present invention comprising injecting a linear polymer into a first mold to form a hemispherical portion shell having a hemispheric inner wall, a hemispheric outer wall, a hemispherically shaped interior volume, and a fill port, where the inner and outer walls also form a rim. Further a linear polymer is injected into a second mold forming a frustum portion shell having a hemispheric inner wall, a frustum shaped outer wall, an interior volume, and a fill port. The frustum portion inner and outer walls form a rim having a profile suitable for mating with the rim formed in the hemispherical portion. Preferably, a circular insert is also molded. Desirably, a suitable weighting agent is placed within the hemispherical shell, the circular insert is then placed between the hemispherical portion and the frustum portion, and the hemispherical portion and the frustum portion are joined together about their rims, trapping the circular insert in place and sealing and isolating the interior volumes of the hemispherical portion and frustum portion from one another. Preferably, any liquid, such as dye, for marking a target struck by the projectile is then dispensed into the hemispherical portion using its fill port and the fill port is then sealed. More preferably, water and/or other liquid marking components for marking also are dispensed into the interior volume of the frustum portion using its fill hole. Alternatively, the marking component can be dispensed into the cylindrical portion only. Again, the fill hole is sealed. Finally, any flashing is removed.

Also preferably, the projectile shell is formed from a linear polymer, such as polystyrene, which is molecularly oriented along circumferential lines in the hemispherical portion extending from the apex of the hemispherical portion toward the cylindrical portion. In one embodiment of the present invention, the projectile shell hemispherical portion preferably has a wall thickness of from about 0.005 inches to about 0.040 inches. Preferably, the wall thickness at or near the rim is greater than the wall thickness at the apex of the hemispherical portion. The cylindrical portion preferably has a wall thickness of from about 0.025 inches to about 0.050 inches measured at or near the rim where the cylindrical portion is joined to the hemispherical portion.

The projectile shell of the present invention may further comprise a circular insert having a first wall facing the interior volume of the hemispherical portion and a second wall facing the interior volume of the cylindrical portion. The circular insert is typically placed between the hemispherical and cylindrical portions prior to joining the hemispherical portion to the cylindrical portion. The circular insert effectively isolates the interior volume of the hemispherical portion from the interior volume of the cylindrical portion. Preferably, the circular insert has a thickness of from about 0.010 inches to about 0.040 inches and a diameter of from about 0.620 inches to about 0.635 inches.

In a second embodiment of the present invention, a projectile shell is provided which comprises a generally hemispherical portion and a frustum portion. The hemispherical portion has a wall with an inner surface and an outer surface wherein the inner surface forms a hemispheric interior volume. The frustum portion also has a wall having an inner surface and an outer surface. The inner surface forms frustum interior volume having the same general shape and volume as the interior volume of the hemispherical portion. The frustum has a diameter at its wide end that is about equal to the diameter of the hemispherical portion and a length that is at least about equal to one-half of that diameter. The hemispherical portion is joined to the wide end of the frustum portion at a rim.

Preferably, the projectile shell of the second embodiment of the present invention is formed from a linear polymer, such as polystyrene, which is molecularly oriented along circumferential lines in the hemispherical portion extending from the apex of the hemispherical portion toward the frustum portion. In one aspect of the second embodiment, the projectile shell hemispherical portion has a wall thickness of from about 0.005 inches to about 0.040 inches. Preferably, the wall thickness at or near the rim is greater than the wall thickness at the apex of the hemispherical portion. The frustum portion preferably has a wall thickness of from about 0.025 inches to about 0.050 inches measured at or near the rim where the frustum portion is joined to the hemispherical portion.

The projectile shell of the second embodiment of the present invention also may further comprise a circular insert having a first wall facing the interior volume of the hemispherical portion and a second wall facing the interior volume of the frustum portion. The circular insert typically is placed between the hemispherical and frustum portions prior to joining the hemispherical portion to the frustum portion. The circular insert effectively isolates the interior volume of the hemispherical portion from the interior volume of the frustum portion. Preferably, the circular insert has a thickness of from about 0.010 inches to about 0.040 inches and a diameter of from about 0.620 inches to about 0.635 inches. The circular insert serves to divide the interior cylindrical portion volume from the interior hemispherical portion volume. In such embodiments, and similar above-described projectiles, the projectile shell comprises at least two separated compartments, which preferably contain separate contents (e.g., a projectile shell comprising a hemispherical portion which contains a chemiluminescent dye and a cylindrical portion which contains a weighting agent). The circular insert can be any suitable insert and can include any modifications necessary for manufacturing and/or assembly (e.g., an inner plastic lip present on one or both sides of the circular insert, which may aid in manufacturing). FIG. 7 shows such a circular insert 600, associated with a lip 620, positioned on one side of the circular insert, which is used to aid in manufacturing of the circular insert.

Projectiles lacking a circular insert also are contemplated. In such projectiles, the hemispherical portion interior volume and cylindrical portion interior volume (or frustum interior portion volume, as applicable) are not isolated from one another.

Preferably, the frustum portion includes at least four fins spaced equal distances apart from each other on its exterior surface. More preferably, the frustum portion includes sixteen fins spaced equal distances apart on its exterior surface. Even more preferably is that each of the fins curves around the exterior surface about 0.0708 revolutions per inch of fin length.

The present invention further relates to a projectile comprising a shell having a hemispherical portion and a cylindrical portion shell. The shell's hemispherical portion has an inner surface and an outer surface forming a wall and a hemispheric interior volume. The cylindrical portion also has an inner surface and an outer surface that forms a wall and the inner surface forms a hemispheric interior volume having the same general shape and volume as the interior volume of the hemispherical portion. The cylindrical portion preferably also has a length that is at least about equal to one-half the diameter of the hemispherical portion. The hemispherical portion is joined to the cylindrical portion at a rim. The projectile of the present invention further includes a marking component to permit identification of the target struck by the projectile. The marking component is preferably located at least within the interior volume of the hemispherical portion. More preferably, the projectile of the present invention further comprises an immobilizing component for immobilizing a target struck by the projectile. Preferably, the immobilizing component is located at least within the interior volume of the hemispherical portion, but can be located within the cylindrical portion, or both portions.

The marking component can be any suitable composition for detectably marking a target as described above. The marking component may be associated with a carrier, such as an aerosol that promotes widespread distribution of the marking component, or a liquid carrier (e.g., water, a lauryl sulfate, or polyethylene glycol).

The immobilizing component can be any composition suitable for immobilizing the target. Suitable immobilizing components include liquid irritants, inflammatory agents, powder irritants, gaseous irritants, lacrimators (e.g., tear gas and/or pepper powders), malodorants (e.g., complex mercaptans (e.g., skunk oil), aliphatic diamines, such as putrescine (tetra methylene diamine) and cadaverine (penta methylene diamine)) or other noxious chemicals, and weighting agents. Suitable irritants and lacrimators include O-chlorobenzylidene malononitrile (CS), chloroacetophenone (CN), chloroacetophenone in chloroform (CNC), bromobenzylcyanide (CA), oleoresincapsicum (OC), methoxycycloheptratriene (MC), and dibenz-(b,f)-1,4-oxazepine (CR). Such agents can be delivered in a carrier, for example a carrier which promotes adsorption and reduces widespread distribution of the agent. For example, CS or CN can be dissolved in dimethyl formamide or other delivery agent, MC can be dissolved in a mixture of anti-oxidants and solvent. Other delivery agents include surfactants, preferably mixed with solvents, such as ethoxylated nonyl phenols, ethoxylated alcohols, sodium lauryl sulfate, ethoxylated alkyloamide, water, and/or polyethylene glycol. Preferred immobilizing weighting agents include the weighting agents described herein (e.g., a metal or alloy having a specific density of about 9–15 g/cc and a Mohs hardness of about 1.5–9.5, such as a tungsten carbide). The weighting agent can be present in any suitable quantity for immobilizing the target, which will vary depending on the target to be immobilized. Preferably, the weighting agent immobilizing component is present in an amount of about 2–15 grams. Alternatively, the projectile can include an electric shock delivery system, as are known in the art.

A projectile of the present invention is further provided in a second embodiment, which comprises a shell having a generally hemispherical portion and a frustum portion. The hemispherical portion has an inner surface and an outer surface forming a wall and a hemispheric interior volume. The frustum portion also has an inner surface and an outer surface that forms a wall and the inner surface forms a hemispheric interior volume having the same general shape and volume as the interior volume of the hemispherical portion. The frustum portion has a diameter at its wide end that is about equal to the diameter of the hemispherical portion and a length which is at least about equal to one-half that diameter. The hemispherical portion is joined to the wide end of the frustum portion at a rim. The projectile further includes a marking component. The marking component can be located within the hemispherical portion interior volume, cylindrical portion inner volume, or the inner volume of both portions, but is preferably located at least within the hemispherical portion interior volume.

Preferably, the projectiles of the present invention include at least four fins spaced equal distances apart on the exterior surface of either the cylindrical portion or the frustum portion, and more preferably, sixteen fins are used. Even more preferably is that each of the fins curves around the exterior surface about 0.0708 revolutions per inch of fin length. Also preferably, the cylindrical portion or the frustum portion has a length greater than one-half of the diameter of the hemispherical portion.

Further provided is a method producing the projectile of the present invention comprising injecting a linear polymer into a first mold to form a hemispherical portion shell having a hemispheric inner wall, a hemispheric outer wall, a hemispherically shaped interior volume, and a fill port, where the inner and outer walls also form a rim. Further, a linear polymer is injected into a second mold forming a cylindrical portion shell having a hemispheric inner wall, a cylindrical outer wall, an interior volume, and a fill port. Additional fill ports may be added or used, but the projectile will typically include at least two fill ports, one associated with the hemispherical portion and one associated with the cylindrical portion or frustum portion, as applicable. The cylindrical portion inner and outer walls form a rim having a profile suitable for mating with the rim formed in the hemispherical portion. A circular insert preferably is also molded.

Preferably, a suitable weighting agent is placed within the hemispherical shell, the circular insert is then placed between the hemispherical portion and the cylindrical portion, and the hemispherical portion and the cylindrical portion are joined together about their rims, trapping the circular insert in place and sealing and isolating the interior volumes of the hemispherical portion and cylindrical portion from one another. Desirably, a marking component, such as a liquid dye, for marking a target struck by the projectile is then dispensed into the hemispherical portion using its fill port and the fill port is then sealed. More preferably, water and/or other liquid marking composition also is dispensed into the interior volume of the cylindrical portion using its fill hole. Again, the fill hole is sealed. Finally, any flashing is preferably removed.

Also provided is a method producing a second embodiment of the projectile of the present invention comprising injecting a linear polymer into a first mold to form a hemispherical portion shell having a hemispheric inner wall, a hemispheric outer wall, a hemispherical shaped interior volume, and a fill port, where the inner and outer walls also form a rim. Further, a linear polymer is injected into a second mold forming a frustum portion shell having a hemispheric inner wall, a frustum shaped outer wall, an interior volume, and a fill port. The frustum portion inner and outer walls form a rim having a profile suitable for mating with the rim formed in the hemispherical portion. A circular insert preferably is also molded. Preferably, a suitable weighting agent is placed within the hemispherical shell, the circular insert is then placed between the hemispherical portion and the frustum portion. The hemispherical portion and the frustum portion are joined together about their rims, trapping the circular insert in place, and sealing and isolating the interior volumes of the hemispherical portion and frustum portion from one another. Preferably, a marking component such as dye, for marking a target struck by the projectile is then dispensed into the hemispherical portion using its fill port and the fill port is then sealed. More preferably, water and/or other marking composition also is dispensed into the interior volume of the frustum portion using its fill hole. Again, the fill hole is sealed. Finally, any flashing is preferably removed.

DETAILED DESCRIPTION OF THE INVENTION

Referring generally to the above figures wherein like numerals indicate like parts, a new, preferably non-lethal, projectile is disclosed which may be fired from generally available compressed gas guns such as paint ball guns with little or no modification to the gun while making use of a minimally modified cartridge magazine for feeding projectiles to the gun. Generally, little or no modification of the currently available guns will be required although a larger air volume may be required to obtain projectile firing distances acceptable to users such as police and military personnel. The projectile has a maximum diameter of about 0.690 inches, the diameter of a typical paint ball. The projectile may have varying lengths depending upon the desired degree of accuracy, although, preferably, in one embodiment, the length should not exceed 0.690 inches to permit the use of generally available paint ball style guns for firing of the new projectiles.

Figure 1A:
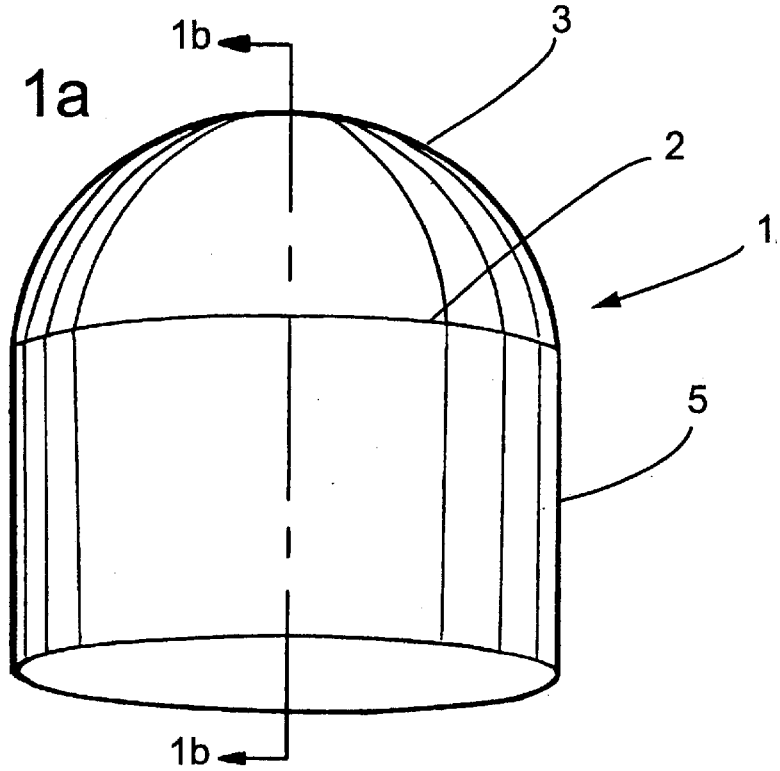
FIG. 1*a* is a perspective view of a first embodiment of the projectile according to the present invention.
Figure 1B:
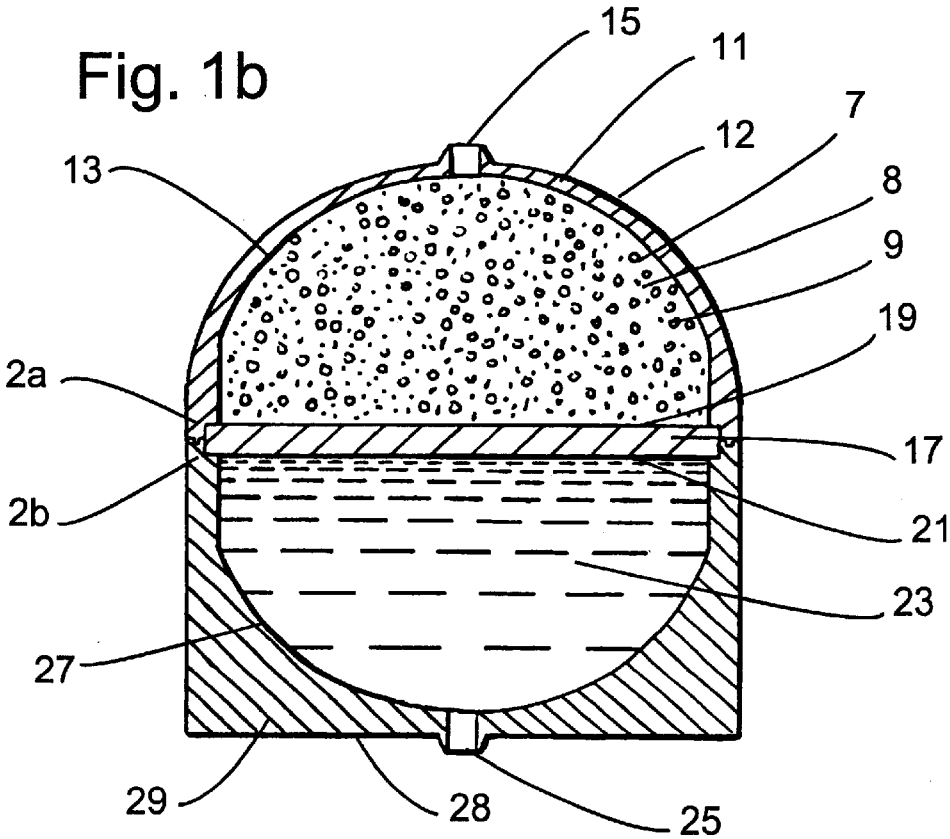
FIG. 1*b* is a cross-sectional view along the line 1*b* of the projectile of FIG. 1*a*.

In its most basic embodiment as seen in FIGS. 1*a* & 1*b*, the projectile comprises a generally hemispherical portion 3 joined to a generally cylindrical portion 5.

The hemispherical portion 3 may be formed from one half of a paint ball shell. A typical paint ball is formed from two hemispherical shells that are then joined together. The hemispherical portion 3 of the present invention is formed from a paint ball hemispheric shell. To accommodate a variety of materials that may be carried by the projectile of the present invention, such as water, preferably, the hemispherical portion 1 is made from a plastic or other moisture resistant material, which, although moisture resistant, preferably does not present a projectile that develops generally lethal force. Such a shell generally has an outside diameter of about 0.680 inches. For instance, the hemispherical portion 3 may be made according to U.S. Pat. Nos. 5,254,379 and 5,639,526. Such a hemispherical shell is resistant to moisture, of sufficient strength to permit manufacture of the desired projectile and yet at the same time presenting a readily frangible leading surface permitting ready marking of the individual struck by the projectile in a stunning, yet preferably non-lethal manner.

One suitable plastic for use in manufacturing the hemispherical portion 3 is a polystyrene marketed under the tradename Novacor and distributed by Polymerland, Inc. This polystyrene is a linear polymer which yields a hemispherical portion that is impervious to water and does not dissolve when contacted by rain or sweat or when placed in a warm humid environment. This impervious nature allows the shell to be used to contain a variety of products including water, smoke, tear gas and other items unsuitable for placement in known gelatin shells.

The hemispherical portion 3 may be formed from a linear polymer in several ways including injection molding and blow molding. However, the preferable method of forming the hemispherical portion 3 of the invention is by injection molding of a linear thermoplastic polymer. In injection molding, the thermoplastic polymer is heated and then injected under high pressures into a mold. Using injection molding, the hemispherical portion 3 may have a thinner, more uniform wall structure.

Figure 1C:
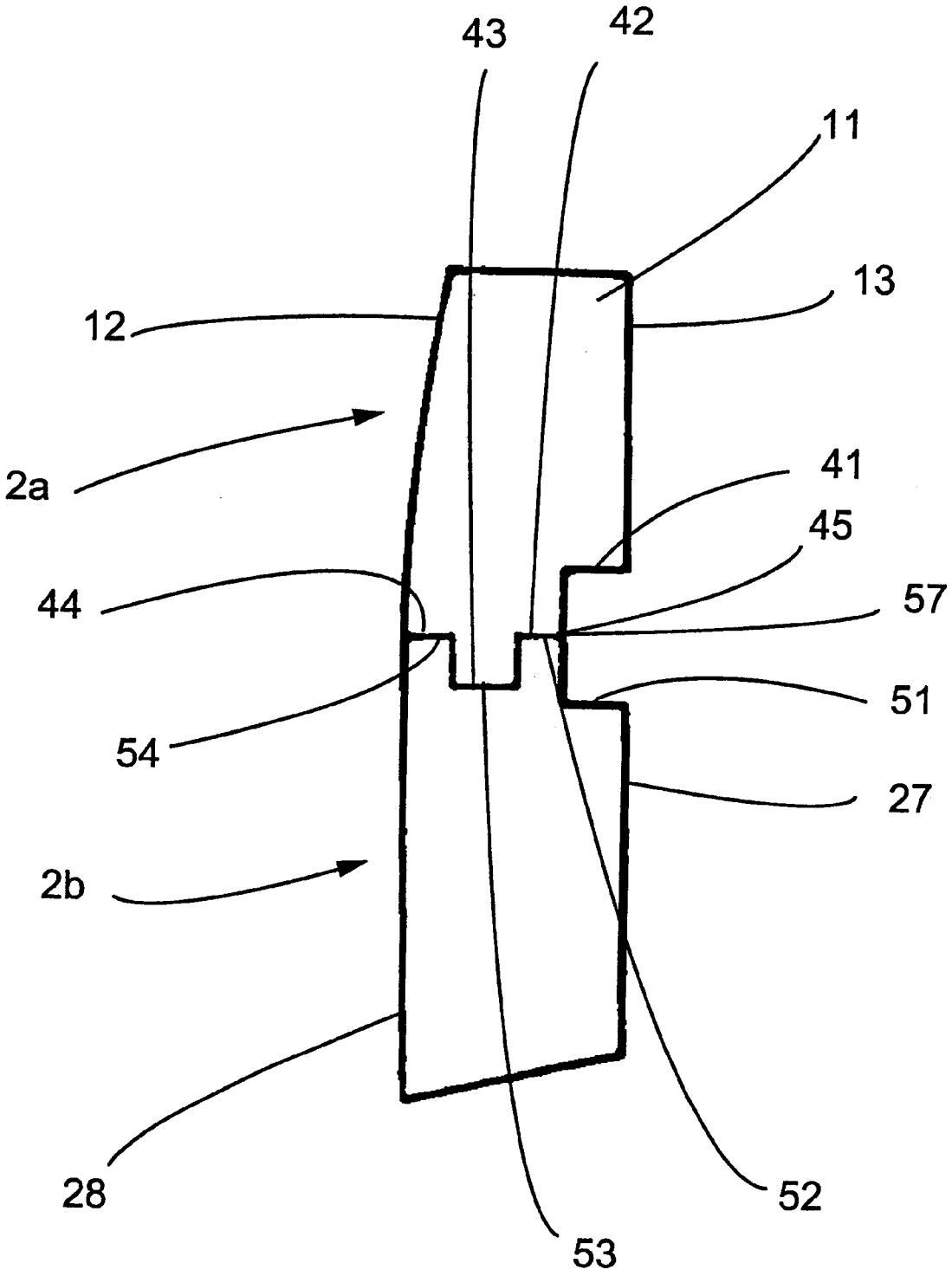
FIG. 1*c* is an enlarged cross-sectional view of the preferred rim shape of the projectile shell of the present invention.

The hemispherical portion 3 generally includes a wall 11 in a hemispherical shape, which has an inner surface 13 and an outer surface 12, which forms the wall 11, which typically has thickness of about 0.005 inches to about 0.040 inches. The wall 11 forms a rim 2*a*, which may be shaped in a variety of known patterns that permit the joining of the hemispherical portion 3 to the cylindrical portion 5. The shape of the rim 2*a* is determined to some extent by the manner in which the cylindrical and hemispherical portions are to be joined—i.e. by solvent welding or by ultrasonic welding. A preferred rim 2*a* shape is illustrated at FIG. 1*c*. Beginning at the outer wall 12, a first shoulder 44 is molded in the outer wall 12, which is preferably about 0.0095 inches from the original rim 2*a* of the hemispherical portion 3 and approximately 0.011 inches deep. The original surface of the rim 2*a* is then left to create a second shoulder 43 for a thickness of 0.011 inches. Projectiles incorporating the preferred rim shape will exhibit a wall of continuous thickness (i.e., about the same thickness as other portions of the projectile), even across the overlap of the hemispherical portion wall and the frustum portion or cylindrical portion wall.

A third shoulder 42 equal in width and depth to the first shoulder 44 is then molded in the original rim 2*a*. Finally, a fourth shoulder 41 is molded which, from the edge 45 of the third shoulder 42 to the shoulder 41, is approximately one-half of the thickness of the circular insert 17 and is molded approximately 0.010 inches into the wall 11. This rim profile is created to match with the rim profile of the cylindrical portion 5 and is especially suitable when using ultrasonic or solvent welding to connect the hemispherical portion 3, the circular insert 17, and the cylindrical portion 5.

At a point on the hemispherical portion 3, preferably the apex, a fill hole 15 is provided for the introduction of material into the projectile after the hemispherical portion 3 is joined to the cylindrical portion 5. After introduction of the material through the fill hole 15, the fill hole is sealed and a generally smooth surface is presented by the projectile in the region of the fill hole 15.

The cylindrical portion 5 may be formed from a variety of materials resistant to water such as plastics such as polystyrene. To simplify manufacturing and to permit easy joining of the cylindrical portion 5 to the hemispherical portion 3, the two portions are preferably manufactured from the same material.

The cylindrical portion 5 may be formed from a linear polymer in several ways including injection molding and blow molding. However, the preferable method of forming the cylindrical portion 5 of the invention is by injection molding of a linear thermoplastic polymer. In injection molding, the thermoplastic polymer is heated and then injected under high pressures into a mold. Using injection molding, the cylindrical portion 5 may have a thinner rim structure and a more uniform wall structure. Preferably, the cylindrical portion is manufactured by injection molding according to the same procedure taught in U.S. Pat. Nos. 5,254,379 and 5,639,526.

One suitable plastic for use in manufacturing the cylindrical portion 5 is a polystyrene marketed under the tradename Novacor and distributed by Polymerland, Inc. This polystyrene is a linear polymer which yields a cylindrical portion that is impervious to water and does not dissolve when contacted by rain or sweat or when placed in a warm humid environment. This impervious nature allows the shell to be used to contain a variety of products including water, smoke, tear gas and other items unsuitable for placement in known gelatin shells.

The cylindrical portion typically has an overall length of about 0.340 inches and an overall diameter equal to that of the hemispherical portion 3. The cylindrical portion 5 as seen in FIG. 1*b* includes a wall 29 having an inner surface 27 and an outer surface 28. The wall 29 forms a volume generally equal to the volume within the hemispherical portion 3 in the same general configuration and shape of the interior of the hemispherical portion 3. As a result, the cylindrical portion 5 wall 29 typically has a varying thickness. Preferably, when in the form of the invention as seen in FIGS. 1*a* & 1*b*, the wall 29 has a thickness of about 0.025 inches to about 0.050 inches at the rim 2*b* where the cylindrical portion 5 is joined to the hemispherical portion 3. The wall 29 thickness then is adjusted to obtain the desired internal volume and shape for the cylindrical portion 5.

A preferred rim shape 2*b* for the cylindrical portion 5 is illustrated at FIG. 1*c*. Beginning at the outer wall 28, a first shoulder 54 of about 0.013 inches deep and about 0.0098 inches to about 0.0103 inches wide is left from the original rim 2*b* which is sized to mate with the first shoulder 44 of the hemispherical rim 2*a*. A slot 53 is then molded in the cylindrical rim 2*b* with a width of about 0.0095 inches (for ultrasonic welding) or about 0.0105 inches (for solvent welding) and a depth of about 0.013 inches sized to mate with the second shoulder 43. A second shoulder 52 is formed from the original surface of the original cylindrical rim 2*b*. The second shoulder 52 is about 0.013 inches deep and is sized to mate with the third shoulder 42 of the hemispherical rim 2*a*.

Finally, a third shoulder 51 is molded which, from the edge 57 of the second shoulder 52 to the third shoulder 51, is approximately one-half of the thickness of the circular insert 17 and is molded approximately 0.010 inches into the wall 27. This rim profile is created to match with the rim profile of the hemispherical portion 3, permit capturing of the circular insert 17, and is especially suitable when using ultrasonic or solvent welding to connect the hemispherical portion 3, the circular insert 17, and the cylindrical portion 5.

The cylindrical portion 5 includes a fill hole 25 for the introduction of material into the cylindrical portion after it is joined to the hemispherical portion 3. After introduction of the material through the fill hole 25, the fill hole is sealed and a generally smooth surface is presented by the projectile in the region of the fill hole 25.

Prior to joining the hemispherical portion 3 to the cylindrical portion 5 at the rim 2, a circular insert 17 having a first wall 19 facing the interior volume of the hemispherical portion 3 and a second wall 21 facing the interior volume of the cylindrical portion 5 is preferably placed between the hemispherical and cylindrical portions. The circular insert 17 preferably has a thickness of about 0.010 inches to about 0.040 inches and a diameter of about 0.620 inches to about 0.635 inches. The circular insert 17 isolates the interior volume of the hemispherical portion 3 from the interior volume of the cylindrical portion 5, allowing differing materials to be inserted into each volume.

The circular insert 17 may be formed from a variety of materials resistant to water and having the appropriate thermal properties. Preferably, the circular insert 17 is formed from a plastic or other moisture resistant material that will not bond with the material from which the hemispherical and cylindrical portions are formed. One suitable plastic for use in manufacturing the circular insert 17 is an acetal homopolymer. The insert 17 is fit between the rim areas 2*a* & 2*b* of the hemispherical and cylindrical portions 3 & 5. When the rims 2*a* and 2*b* are joined to form the rim 2, the insert 17 is integrated into the rim, thereby sealing the interior volumes of both the cylindrical portion 5 and the hemispherical portion 3 and isolating one interior volume from the other.

In other aspects, a projectile lacking a circular insert is preferred. For example, when a weighting agent immobilizing composition is deposited throughout the interior of the projectile and the hemispherical and cylindrical portions are not divided. Such projectiles can include any suitable marking component, immobilizing component, or combination thereof.

Preferably, the hemispherical portion 3, the cylindrical portion 5 and the circular insert 17 are each formed by injection molding a suitable plastic. Various advantages flow readily from the construction of the paint ball shell 3 from a linear polymer. A particularly suitable plastic for the hemispherical and cylindrical portions is a linear polymer such as polystyrene although any workable plastic or other comparable material may be used. Linear polymers are particularly suitable because they are easily handled and molded into easily controlled accurate shapes. For instance, the hemispherical portion 3 of the present invention when formed from linear polystyrene may be constructed within a tolerance of less than 0.002 inches out of round.

Once the three component parts are prepared, they are joined together, preferably by ultrasonic welding although other suitable techniques such as solvent welding may be used employing conventional techniques. Following the joining of the three component pieces, material may be injected into the interior volumes of the hemispherical portion 3 and the cylindrical portion 5 through the appropriate fill holes. The fill holes may then be sealed using conventional techniques such as a fill and seal injection needle.

Figure 2A:
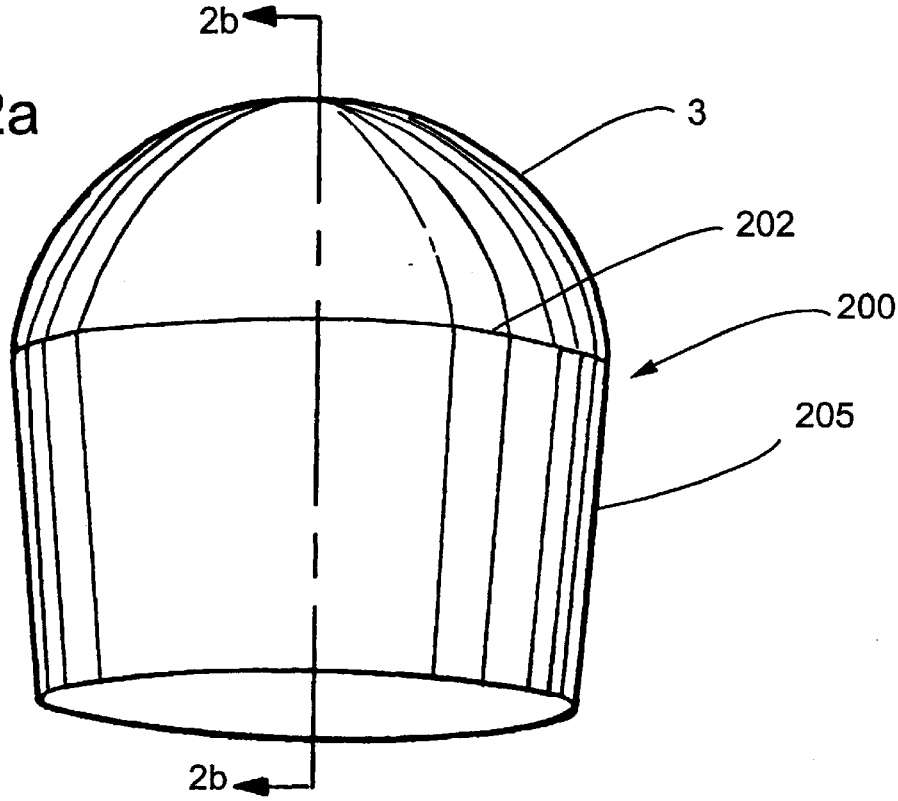
FIG. 2*a* is a perspective view of a second embodiment of the projectile according to the present invention.
Figure 2B:
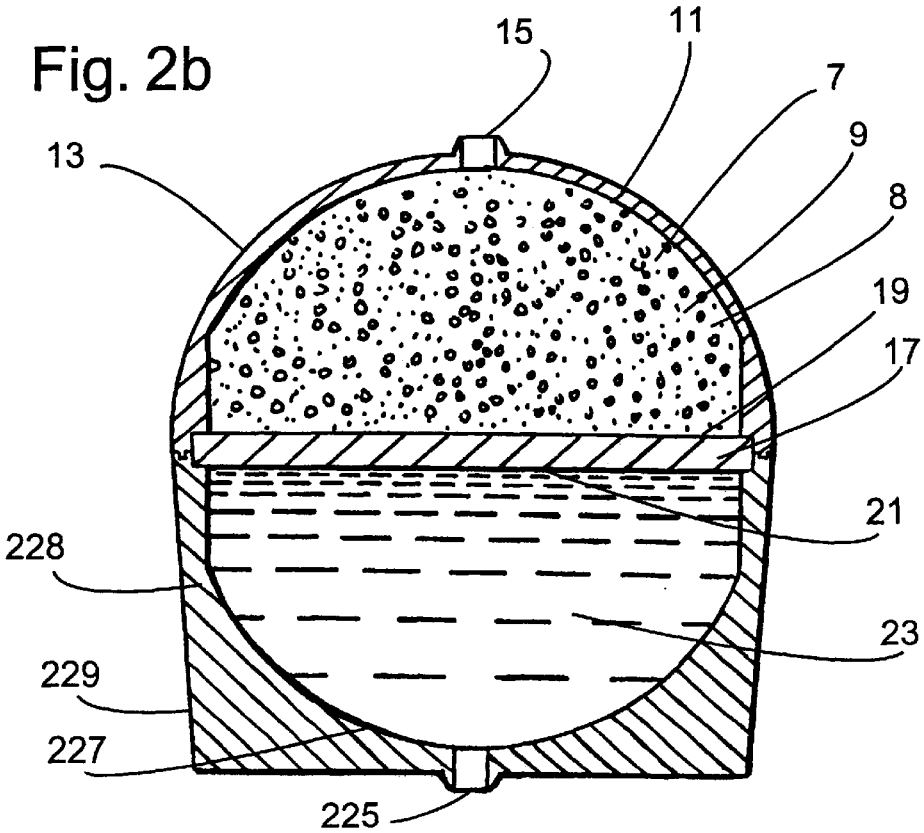
FIG. 2*b* is a cross-sectional view along the line 2*b* of the projectile of FIG. 2*a*.

In a second embodiment 200 of the present invention, as seen in FIGS. 2*a* and 2*b*, a hemispherical portion 3, a circular insert 17, and a frustum shaped cylinder 205. The first hemispherical portion 3 is constructed as described above in relation to FIGS. 1*a*, 1*b* & 1*c*. Likewise, the circular insert is constructed as discussed above. Rather than the cylindrical portion 5 described above, a hollow frustum 205 replaces the cylindrical portion 5. The hollow frustum tapers from a diameter equal to that of the hemispherical portion 3 of about 0.680 inches to a minimum diameter of about 0.625 inches at its furthest extent.

The hollow frustum 205 as seen in FIG. 2*b* includes a wall 229 having an inner surface 227 and an outer surface 228. The wall 229 forms a volume generally equal to the volume within the hemispherical portion 3 in the same general configuration and shape of the interior of the hemispherical portion 3. As a result, the hollow frustum 205 wall 229 has a varying thickness. Preferably when in the form of the invention as seen in FIGS. 2*a* & 2*b*, the wall 229 has a thickness of about 0.025 inches to about 0.050 inches at the rim 202*b* where the hollow frustum 205 is joined to the hemispherical portion 3. The wall 229 thickness then is adjusted to obtain the desired internal volume and shape for the hollow frustum 205.

Figure 2C:
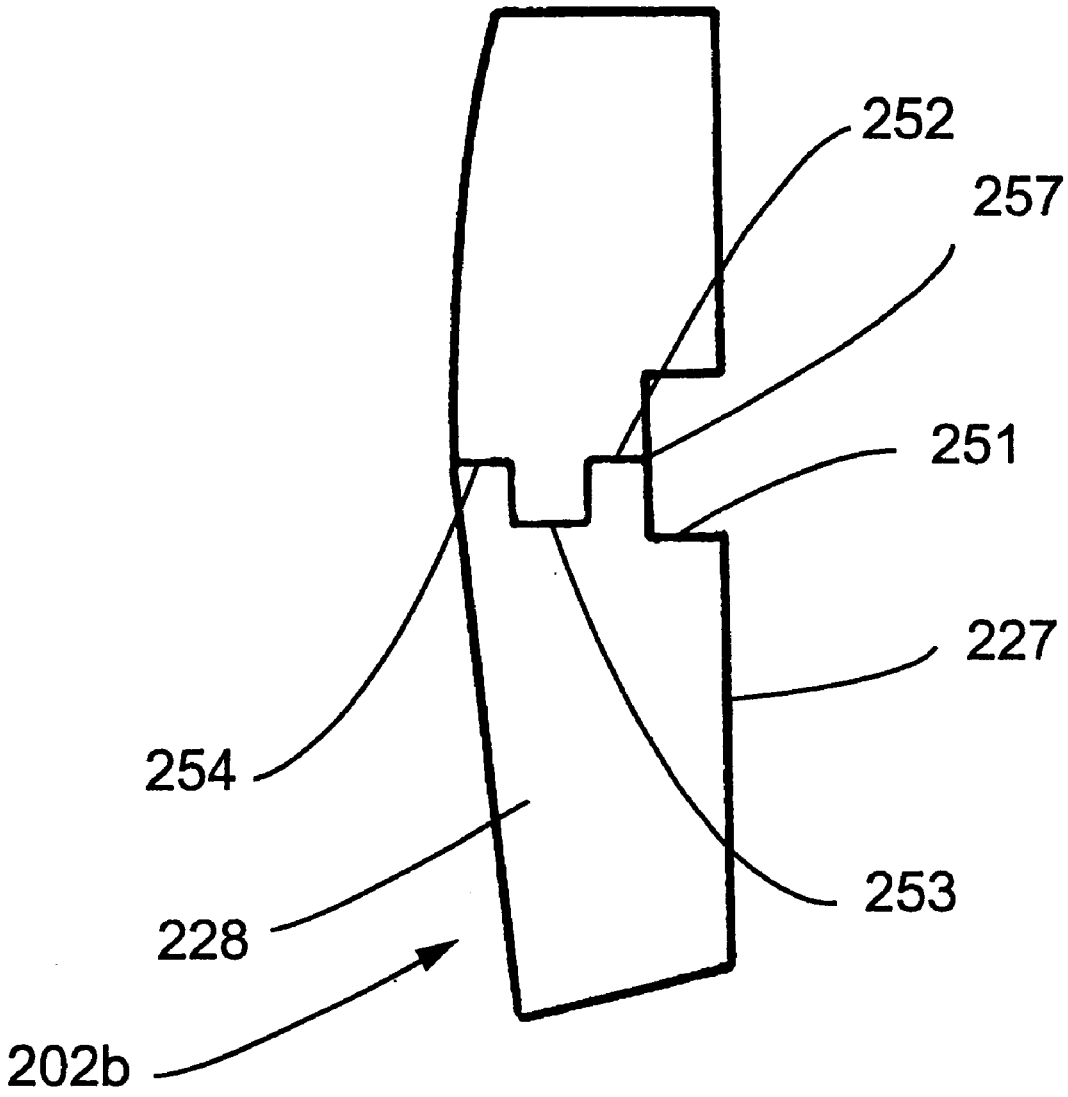
FIG. 2*c* is an enlarged cross-sectional view of the preferred rim shape of a second embodiment of the present invention.

A preferred rim shape 202*b* for the hollow frustum 205 is illustrated at FIG. 2*c*. Beginning at the outer wall 228, a first shoulder 254 of about 0.013 inches deep and about 0.0098 inches to about 0.013 inches wide is left from the original rim 202*b*, which is sized to mate with the first shoulder 44 of the hemispherical rim 2*a*. A slot 253 is then molded in the hollow frustum rim 202*b* with a width of about 0.0095 inches (for ultrasonic welding) or about 0.0105 inches (for solvent welding) and a depth of about 0.013 inches sized to mate with the second shoulder 43 of the hemispherical rim 2*a*. A second shoulder 252 is formed from the original surface of the original hollow frustum cylindrical rim 202*b*. The second shoulder 252 is about 0.013 inches deep and is sized to mate with the third shoulder 42 of the hemispherical rim 2*a*. Finally, a third shoulder 251 is molded which, from the edge 257 of the second shoulder 252 to the third shoulder 251, is approximately one-half of the thickness of the circular insert 17 and is molded approximately 0.010 inches into the wall 27. This rim profile is created to match with the rim profile of the hemispherical portion 3, permit capturing of the circular insert 17, and is especially suitable when using ultrasonic or solvent welding to connect the hemispherical portion 3, the circular insert 17, and the hollow frustum 205.

The hollow frustum 205 includes a fill hole 225 for the introduction of material into the hollow frustum 205 after it is joined to the hemispherical portion 3. After introduction of the material through the fill hole 225, the fill hole is sealed and a generally smooth surface is presented by the projectile in the region of the fill hole 225.

As with the above described cylindrical portion 5, the hollow frustum 205 may be formed from a variety of water resistant materials such as plastics such as polystyrene also mentioned in relation to the cylindrical portion 5. To simplify manufacturing and to permit easy joining of the hollow frustum 205 to the hemispherical portion 3, the two portions are again preferably manufactured from the same material. Preferably, the hollow frustum 205 is manufactured by injection molding according to the same procedure taught in U.S. Pat. Nos. 5,254,379 and 5,639,526.

Figure 3A:
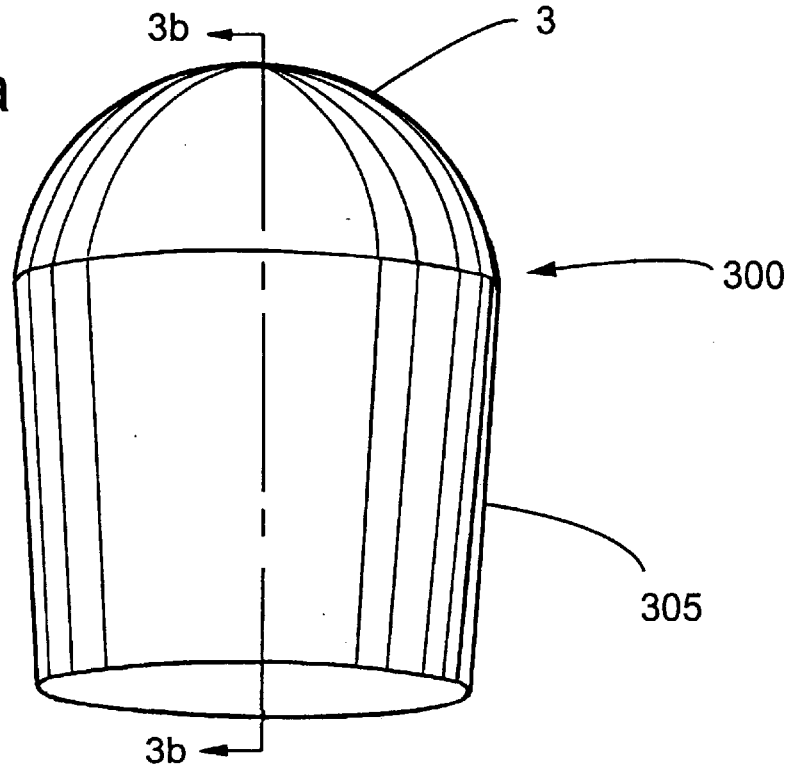
FIG. 3*a* is a perspective view of a third embodiment of the projectile according to the present invention.
Figure 3B:
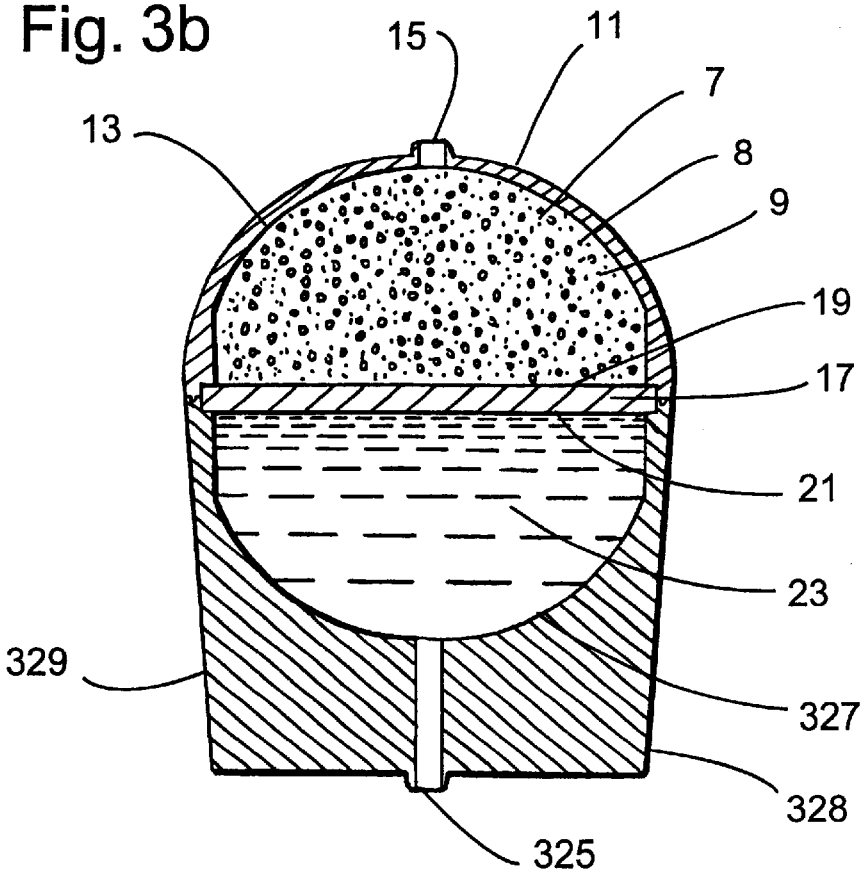
FIG. 3*b* is a cross-sectional view along the line 3*b* of the projectile of FIG. 3*a*.

A third embodiment 300 of the present invention is seen in FIGS. 3*a* and 3*b*. In this embodiment, a hemispherical portion 3, a circular insert 17, and a long hollow frustum 305 are joined to form a non-lethal projectile. This embodiment is identical to that seen in FIGS. 2*a*, 2*b* & 2*c* except that the hollow frustum 305 is extended for a greater length of about 0.500 inches. It should be noted that a projectile formed from a frustum of this extended length may require the use of a modified paintball gun. The three pieces are connected together in the same manner as described in relation to the second embodiment 200 described above.

As noted above, the third embodiment 300 of this projectile of the present invention includes a long hollow frustum 305. While the hollow frustum is extended, its interior hollow volume is limited to the same general configuration and shape of the interior of the hemispherical portion 3. As a result, the hollow frustum 305 wall 329 has a varying thickness. Preferably when in the form of the invention as seen in FIGS. 3*a* & 3*b*, the wall 329 has a thickness of about 0.025 inches to about 0.050 inches at the rim 302*b* where the long hollow frustum 305 is joined to the hemispherical portion 3. The wall 329 thickness then is adjusted to obtain the desired strength, internal volume, and shape for the hollow frustum 205.

The hollow frustum 305 includes a fill hole 325 for the introduction of material into the long hollow frustum 305 after it is joined to the hemispherical portion 3. Since a long hollow frustum 305 is used, a longer fill channel connects the fill hole 325 with the interior chamber of the long hollow frustum 305. After introduction of the material through the fill hole 325, the fill hole is sealed and a generally smooth surface is presented by the projectile in the region of the fill hole 325.

Figure 4A:
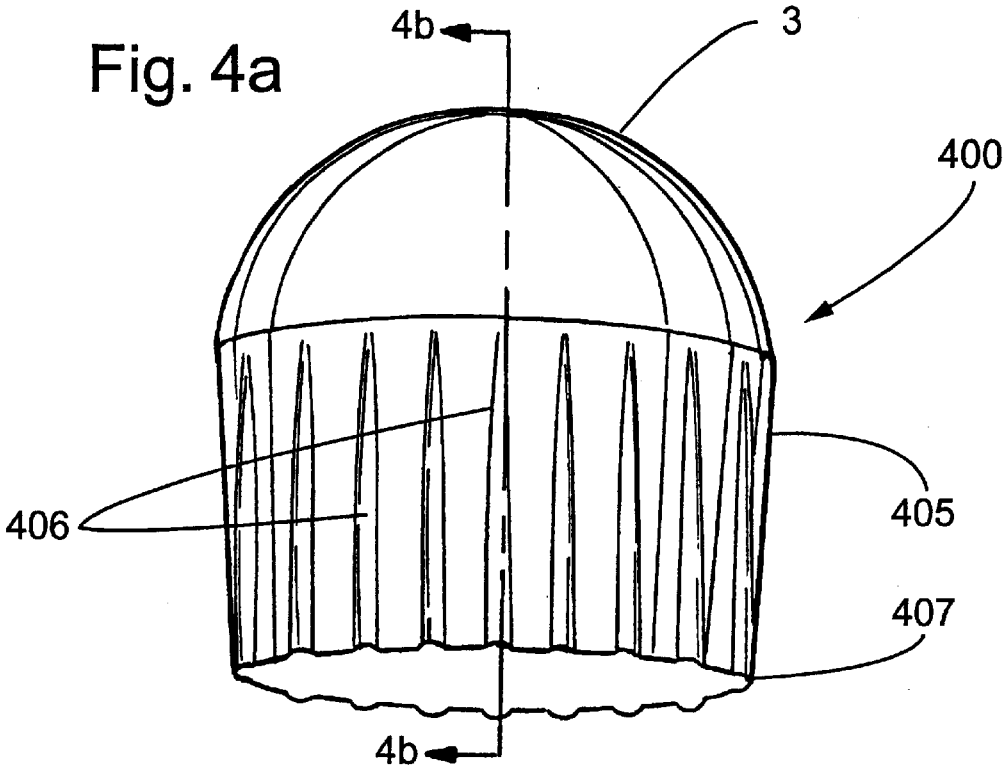
FIG. 4*a* is a perspective view of a fourth embodiment of the projectile according to the present invention.
Figure 4B:
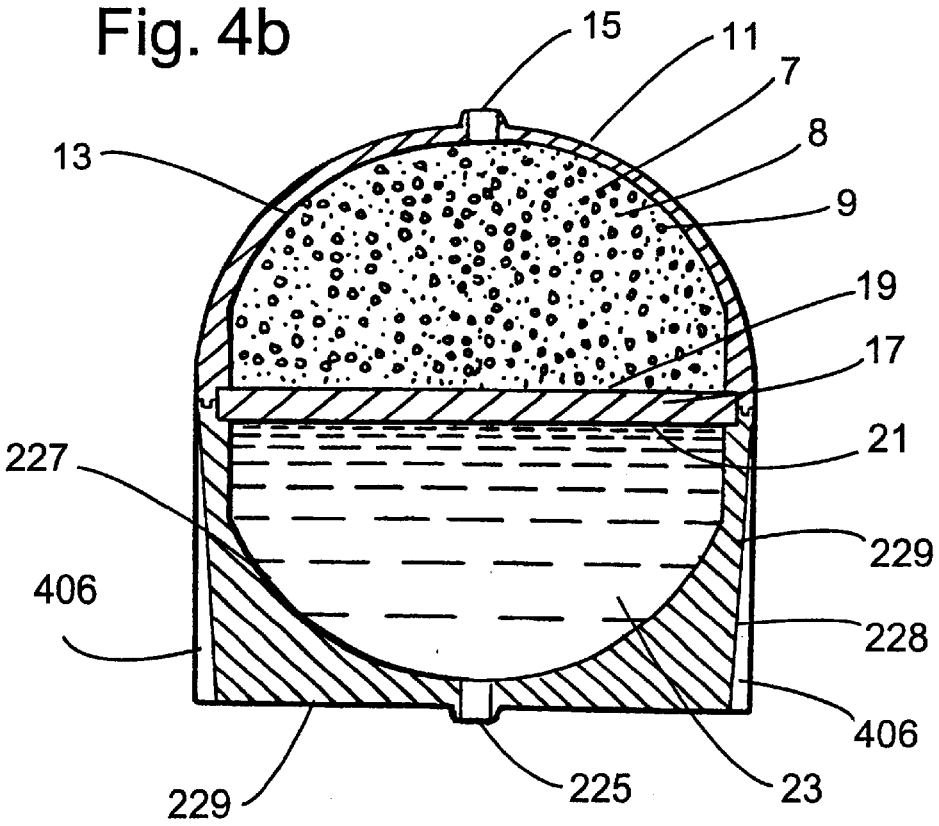
FIG. 4*b* is a cross-sectional view along the line 4*b* of the projectile of FIG. 4*a*.

A fourth embodiment 400 of the present invention is seen in FIGS. 4*a* and 4*b*. The fourth embodiment is identical to that seen in FIGS. 2*a*, 2*b* & 2*c* except that fins 406 have been added to the exterior surface of the hollow frustum. Fins are added to promote stable accurate flight. Preferably the fins exhibit curvature around the surface of the hollow frustum. Such curvature imparts a spinning motion to the projectile as it flies through the air. Such spinning motion imparts added stability and accuracy to the projectile when fired increasing the probability of hitting the intended target.

Preferably, there are at least four fins, more preferably at least eight fins and, even more preferably, there are sixteen fins 406 spaced equal distances apart around the surface of the hollow frustum. The fins 406 extend from at or near the rim 202*b* of the hollow frustum 405 and extend to the base of the hollow frustum. The extensions of the fins beyond the surface of the hollow frustum 405 begins initially at zero to very nearly zero and increase gradually along the length of the hollow frustum 405 such that the overall diameter of the finned hollow frustum 407 is about equal to the outside diameter of the hemispherical portion 3. Given the decreasing diameter of the hollow frustum 405 itself, this yields fins 406 which extend from the surface of the hollow frustum 405 in ever increasing amounts. At the base of the hollow frustum, the fins 406 preferably extend about 0.032 inches from the surface 228 of the hollow frustum 405. Preferably, where there are sixteen fins 406, the fins have a width at their initiation point at or near the rim of about 0.020 inches and width of about 0.020 inches at the point where the fins 406 end at the base of the hollow frustum 405.

Even more preferable when applying fins 406 to the surface of the hollow frustum 405 is for the fins to curve slightly as they traverse the length of the hollow frustum 405. Preferably, a single fin 406 will curve around approximately 0.0708 revolutions per inch of fin length.

Figure 5A:
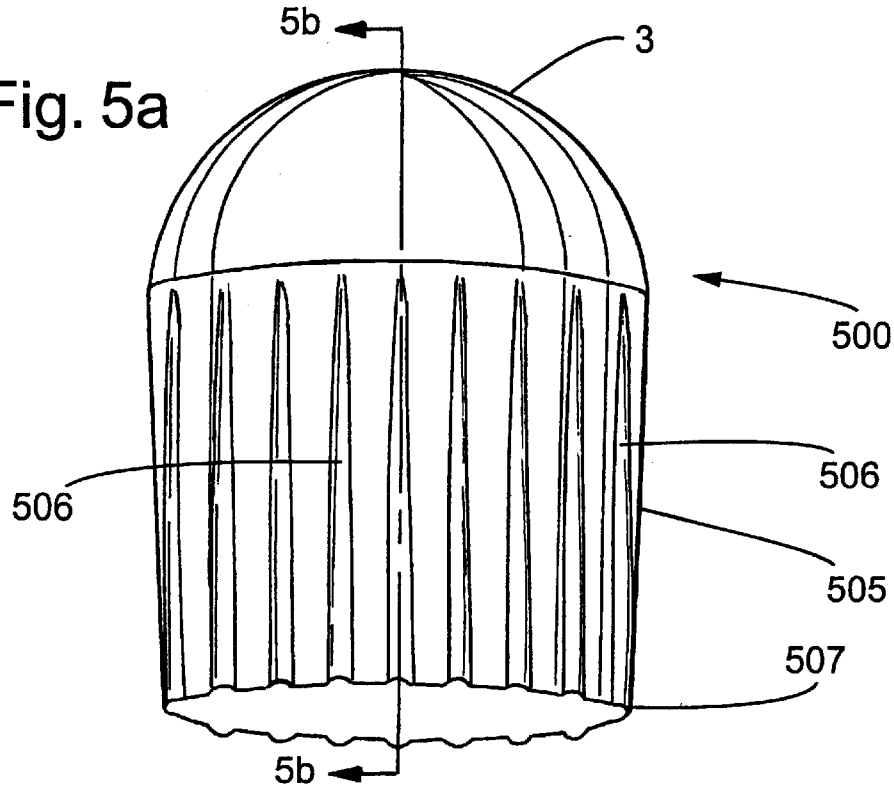
FIG. 5*a* is a perspective view of a fifth embodiment of the projectile according to the present invention.
Figure 5B:
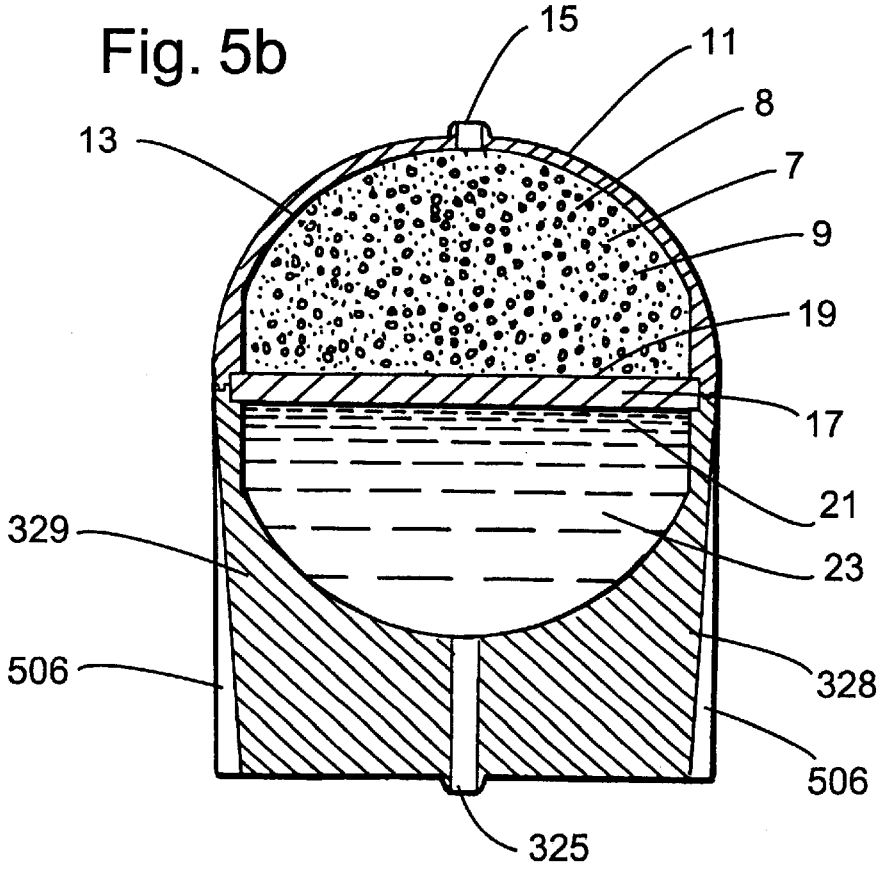
FIG. 5*b* is a cross-sectional view along the line 5*b* of the projectile of FIG. 5*a*.

A fifth embodiment 500 of the present invention is seen in FIGS. 5*a* and 5*b*. The fifth embodiment is identical to that seen in FIGS. 3*a* & 3*b* except that fins 506 have been added to the exterior surface of the long hollow frustum. Fins are added to promote stable accurate flight. Preferably the fins exhibit curvature around the surface of the hollow frustum. Such curvature imparts a spinning motion to the projectile as it flies through the air. Such spinning motion imparts added stability and accuracy to the projectile when fired increasing the probability of hitting the intended target.

Preferably, there are at least four fins, more preferably at least eight fins and, even more preferably, there are sixteen fins 506 spaced equal distances apart around the surface of the hollow frustum. The fins 506 extend from at or near the rim 202*b* of the long hollow frustum 505 and extend to the base of the long hollow frustum. The extensions of the fins beyond the surface of the long hollow frustum 505 begins initially at zero to very nearly zero and increase gradually along the length of the long hollow frustum 505 such that the overall diameter of the finned long hollow frustum 507 is about equal to the outside diameter of the hemispherical portion 3. Given the decreasing diameter of the long hollow frustum 505 itself, this yields fins 506 which extend from the surface of the long hollow frustum 505 in ever increasing distances. At the base of the long hollow frustum, the fins 506 preferably extend 0.045 inches from the surface 328 of the long hollow frustum 505. Preferably, where there are sixteen fins 506, the fins have a width at their initiation point at or near the rim of about 0.020 inches and width of about 0.020 inches at the point where the fins 506 end at the base of the long hollow frustum 505.

As noted above, most preferable when applying fins 506 to the surface of the long hollow frustum 505 is for the fins to curve slightly as they traverse the length of the long hollow frustum. Preferably, a single fin 506 will curve around approximately 0.0708 revolutions per inch of fin length.

Figure 8A:
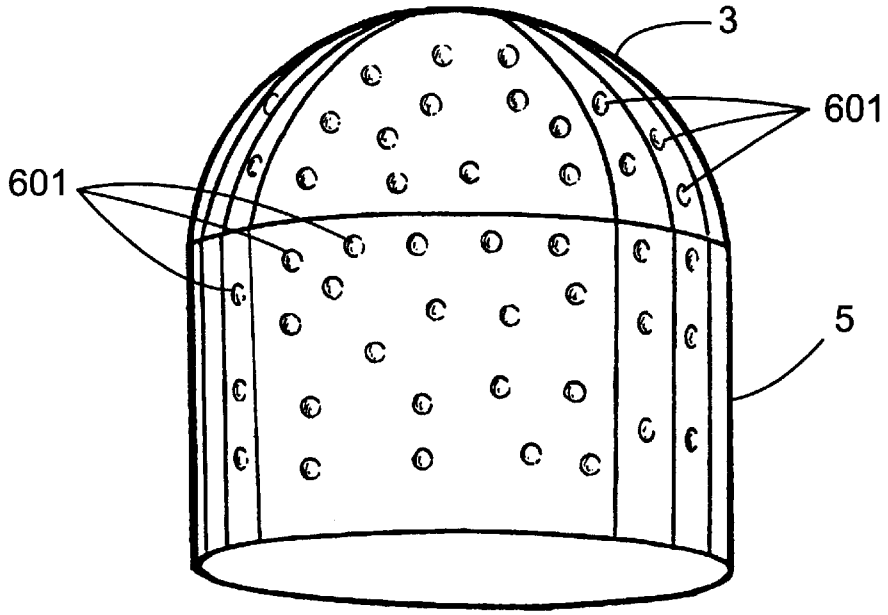
FIG. 8*a* is a perspective view of a sixth embodiment of the projectile according to the present invention.

A sixth embodiment 600 of the present invention is seen in FIG. 8*a*. The sixth embodiment is identical to that seen in FIG. 1*a* except that the projectile comprises a plurality of dimples 601. The plurality of dimples promotes projectile accuracy, distance, or both.

Figure 8B:
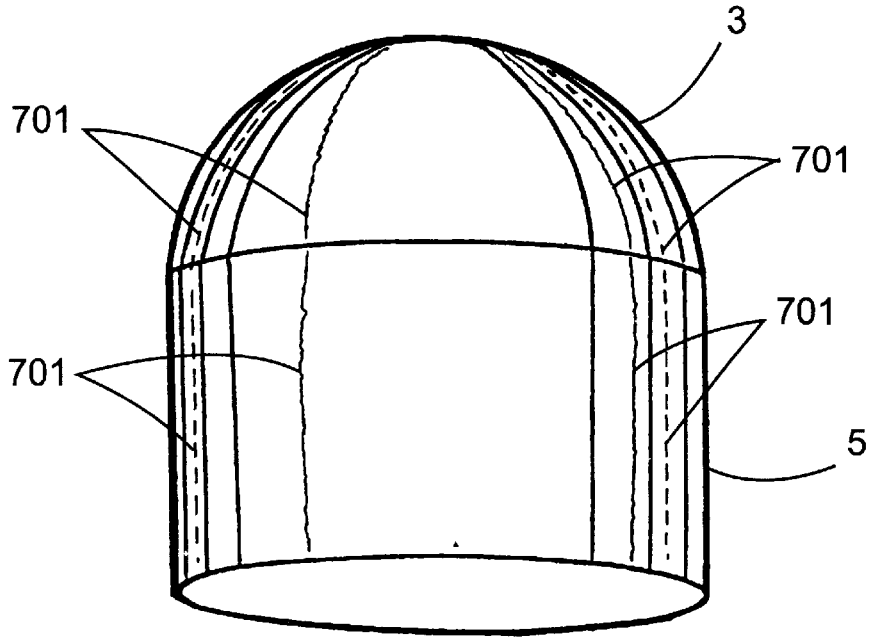
FIG. 8*b* is a perspective view of a seventh embodiment of the projectile according to the present invention.

A seventh embodiment 700 of the present invention is seen in FIG. 8*b*. The seventh embodiment is identical to that seen in FIG. 1*a* except that the projectile comprises scoring 701 on or in the surface of the hemispherical portion 3 and on or in the surface of the cylindrical portion 5. The scoring promotes fracture at the surface locations comprising the scoring.

Figure 8C:
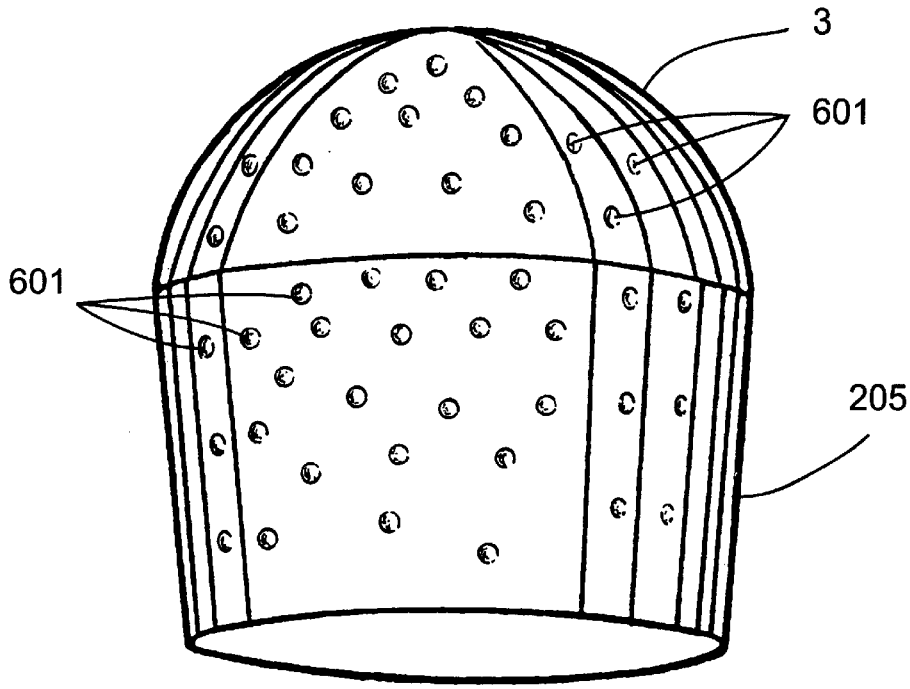
FIG. 8*c* is a perspective view of an eighth embodiment of the projectile according to the present invention.

An eighth embodiment 800 of the present invention is seen in FIG. 8*c*. The eighth embodiment is identical to that seen in FIG. 2*a* except that the projectile comprises a plurality of dimples 601. The plurality of dimples promotes projectile accuracy, distance, or both.

Figure 8D:
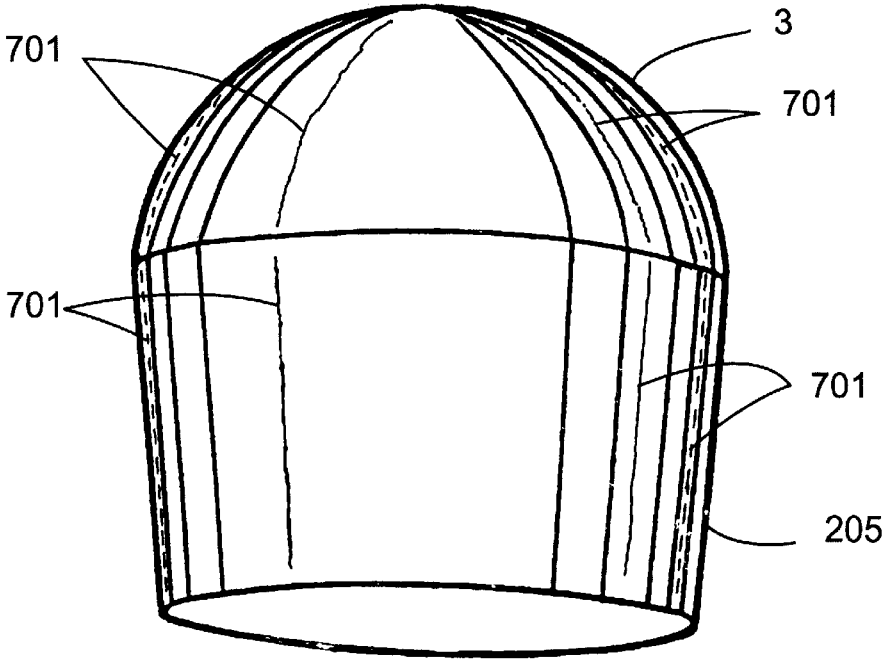
FIG. 8*d* is a perspective view of a ninth embodiment of the projectile according to the present invention.

A ninth embodiment 900 of the present invention is seen in FIG. 8*d*. The ninth embodiment is identical to that seen in FIG. 2*a* except that the projectile comprises scoring 701 on or in the surface of the hemispherical portion 3 and scoring on or in the surface of the hollow frustum 205. The scoring promotes fracture at the surface locations comprising the scoring.

As noted above, the hemispherical portion 3 in each embodiment includes a fill hole 15 through which fill material may be introduced and sealed into the cavity 7 of the hemispherical portion 3. Such material is typically a fluid 8 in combination with a colorant. In addition, to obtain the desired weight relationship in the projectile, a weighting agent may be introduced into the hemispherical portion before it is joined to the cylindrical or frustum portion, or visa versa.

A first concern in using a non-lethal projectile is to mark the victim with in some manner to enable identification and arrest once a disturbance is ended. Generally, the cavity 7 may be filled with a marking component, which typically will include a coloring agent to provide marking capability. Suitable coloring agents can be liquid or powder dyes. One such suitable coloring agent is a water soluble dye dispersed in water. Such a dye ultimately may be readily washed from the skin and clothing of a victim struck by the non-lethal projectile of the present invention. This permits the victim to remove the dye after apprehension. Another suitable coloring agent is a permanent dye.

Other suitable coloring agents include dyes which can be detected by infra red or ultraviolet light. Still other suitable coloring agents include dyes which glow in the dark to permit detection of identified individuals who have been marked during day light hours. In cases where the coloring agent is a chemical dye that is not compatible with the shell material, the coloring agent may be placed in miniature glass ampules which are subsequently added to the interior compartment. The use of glass ampules allows even a wider variety of chemicals to be used in combination with various shell materials. The glass ampules are preferably introduced into the cavity 7 of the hemispherical portion 3 prior to the joining of the hemispherical and cylindrical or frustum portions. Alternatively or additionally, the portions of the projectile can be further subdivided, e.g., by inserting one or more dividers into the portions.

Preferred glow in the dark dyes include chemiluminescent dyes (e.g., cold reaction dyes) and phosphorescent dyes. Any suitable chemiluminescent dye can be contained within the hemispherical portion, cylinder portion, or both portions. Examples of such dyes include Luminol (5-amino-2,3-dihydro-1,4-phthalazinedione) (which reacts with hydrogen peroxide, base, and preferably a metal catalyst, to form 3-aminophtahalate (3-APA) that emits a blue light in the presence of an aqueous alkali or a green-yellow light when reacted with dimethyl sulphoxide—see, e.g., White and Roswell., in Chemi- and Bioluminescence (Marcel Dekker, New York, 1985) p. 215)), copper-doped zinc suflate (preferably when used in bright light conditions), nitrogen monoxide (reacted with ozone), methylselenide ($CH_3Se$—see, e.g., Glinski et al., *J.A.C.S,* 108, 531 (1986)), cyanide (CN—see, e.g., Sutton et al., *Anal. Chem.,* 51, 1399 (1979)), fluoromethylene (see, e.g., Glinski et al., *J Photochem.,* 37, 217 (1987)), formaldehyde (see, e.g., Finlayson et al., *J.A.C.S.,* 96, 5356 (1974)), HF (see, e.g., Glinski (1987), supra), hydrogen sulfoxide (Toby, *Chem. Rev.,* 84, 277, (1984)), iodine monofluoride (see Getty and Birks, *Anal. Lett.,* 12, 469 (1979), lucigene (which forms N-methylacridone) (see, e.g., Totter, *Photochem. Phtobiol.,* 22, 203 (1975)), lucigenin (which forms a blue-green light when reacted with hydrogen peroxide), lophine (which produces a yellow light when reacted with alcoholic sodium dyroxide), luciferin (which forms oxyluciferin when oxidized in the presence of ATP with firefly luciferase—see, e.g., Seitz, *Crc. Crit. Rev. Anal. Chem.,* 13, 1 (1981)), peroxyoxalate (which can be mixed with various sensitizers to emit different types of light), tris(2-2'-bipyridyl) ruthenium(III) ($Ru(bpy)_3$) (which forms an orange light when reacted with oxalate—see, e.g., Rubinstein et al., *Anal. Chem.,* 55, 1580 (1983)), sulfur dioxide (see Spurlin and Yeung, *Anal. Chem.,* 54, 318 (1982)), sulfur difluoride (see, e.g., Glinski and Taylor, *Chem. Phys. Lett.,* 155, 511 (1989)), nitrogen dioxide, peroxide, tetrakis(dimethylamino)ethylene (which provides a pale green glow when reacted with oxygen by forming tetramethylurea and oxygen), other oxalic acid esters (e.g., isoluminol, peroxidase, and bis-trichloropheyloxalate), and various alkaloids reacted with potassium permaganate in the presence of polyphosphates (see generally, Araka et al., *Chem. Pharm. Bull.,* 30, 3026 (1982) and Gunderman and McCapra, Chemiluminescence in Organic Chemistry (Springer-Verlag (1987)). Preferably, the chemiluminescent dye is non-harmful to humans upon contact. For example, yellow phosphorous dyes are preferably not used for human targets, although such dyes are highly luminescent even in near total darkness.

Preferably, the chemiluminescent dye is composed of two reactants necessary for chemiluminescence that are contained in separate portions of the hemispherical portion, cylindrical portion (or frustum portion, as applicable), or both portions, or separately contained in the hemispherical and cylindrical portions (e.g., in the aforementioned ampules). Such projectiles will preferably permit the mixing of the components upon impact with a target thereby causing luminescence, but will prevent the mixing of the reactants prior to impact. Thus, such projectiles will include a circular insert and may include other components that will maintain the isolation of the reactants in the two portions or the projectile prior to impact. The projectile can be modified to promote mixing, such as by directed indentations or scoring near the circular insert to promote rupture nearby such that mixing of the reactants is maximized. Alternatively, a modified circular insert that will readily rupture upon impact can be used. Any suitable combination of reactants can be used (e.g., an oxalic-type ester can be contained in one portion and a hydroperoxide in another to produce a projectile suitable for night use). Preferably, the chemiluminescent dye is a strong enough emitter of light and provided in a suitable concentration such that when the projectile impacts on a surface (e.g., a wall or tree), the reactants mix and emit sufficient light to light up the immediate area of the surface for a period of time (e.g., 3 seconds, 5 seconds, 15 seconds, 20 seconds, or longer), thereby permitting the user to see an area in the dark for short periods of time.

Alternatively or additionally, a phosphorescent material can be incorporated into the hemispherical portion, the cylindrical (or frustum) portion, or both portions. Any suitable phosphorescent material can be used. Examples of such materials include zinc sulfide, calcium sulfide, and strontium sulfide compositions (or mixtures thereof), doped with a photon absorbing or emitting material (an "activator")

such as copper, manganese, or bismuth, which may be associated with a surfactant (such as an oxazoline-type surfactant, a fatty alcohol phospate surfactant, a TWEEN, or polyoxyethylene-sorbitane-monolaurate). The particular combination depends on the type of light to be emitted. For example, zinc sulfide gels doped with copper emit green light trails when subjected to an exciting radiation (typically, UV light). To activate such materials the phosphorescent material must be subject to an exciting radiation, which can be provided by an external device applied after impact, or, preferably, by an exciter which is incorporated into the device (e.g., paintball gun) from which the projectile is fired. Such guns are known in the art.

Alternatively or additionally, the cavity 7 of the invention may be filled with an immobilizing component, such as an irritant or other noxious chemical. The irritant or noxious chemical can be in a liquid, powder, or a gaseous state. Suitable irritants include eye irritants, such as pepper powder or tear gas. Suitable noxious agents include such chemicals as malodorants which induce nausea and/or vomiting. As discussed above, any immobilizing component not compatible with the shell material may be placed in miniature glass ampules which are subsequently added to the interior compartment.

Preferably, the fill material in the cavity 7 includes the coloring agent and a weighting agent 9 (e.g., a tungsten carbide weighting agent) to obtain the desired weight relationship in the projectile. The weighting agent is introduced into the cavity 7 of the hemispherical portion 3 prior to the joining of the hemispherical and cylindrical or frustum portions.

Alternatively or additionally, the weighting agent for any of the projectiles described herein can be administered through a fill port of the hemispheric portion, cylindrical or frustum portion, as applicable, or into both portions through their respective fill ports. Introduction of the weighting agent into the cavity of the hemispherical portion, cylindrical portion, frustum portion, or both portions, prior to joining the portions, is typically preferred.

Figure 6:
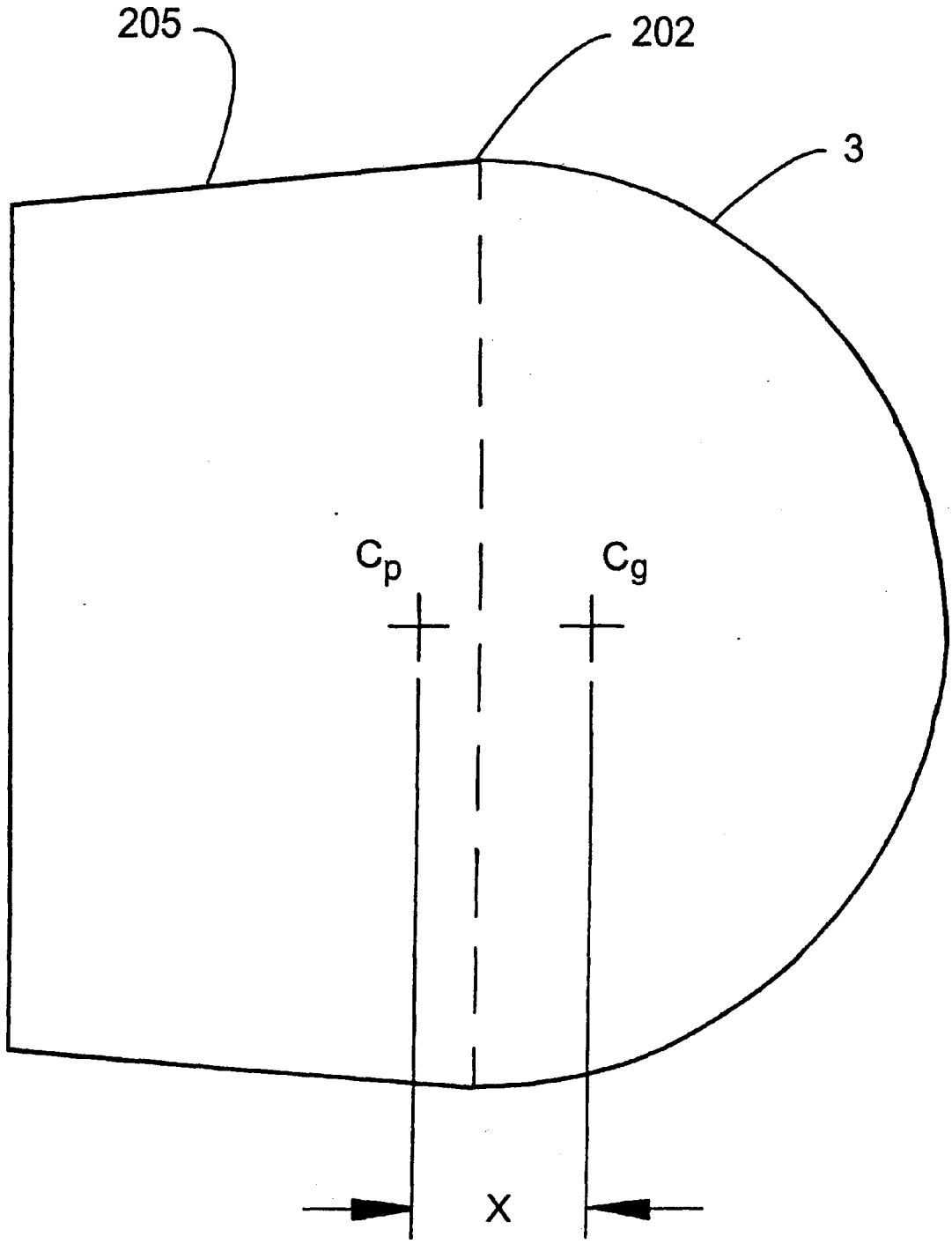
FIG. 6 is a perspective view showing the positional relationship between the preferred center of gravity (Cg) and the preferred center of pressure (Cp) for a projectile of the present invention.
Figure 7:
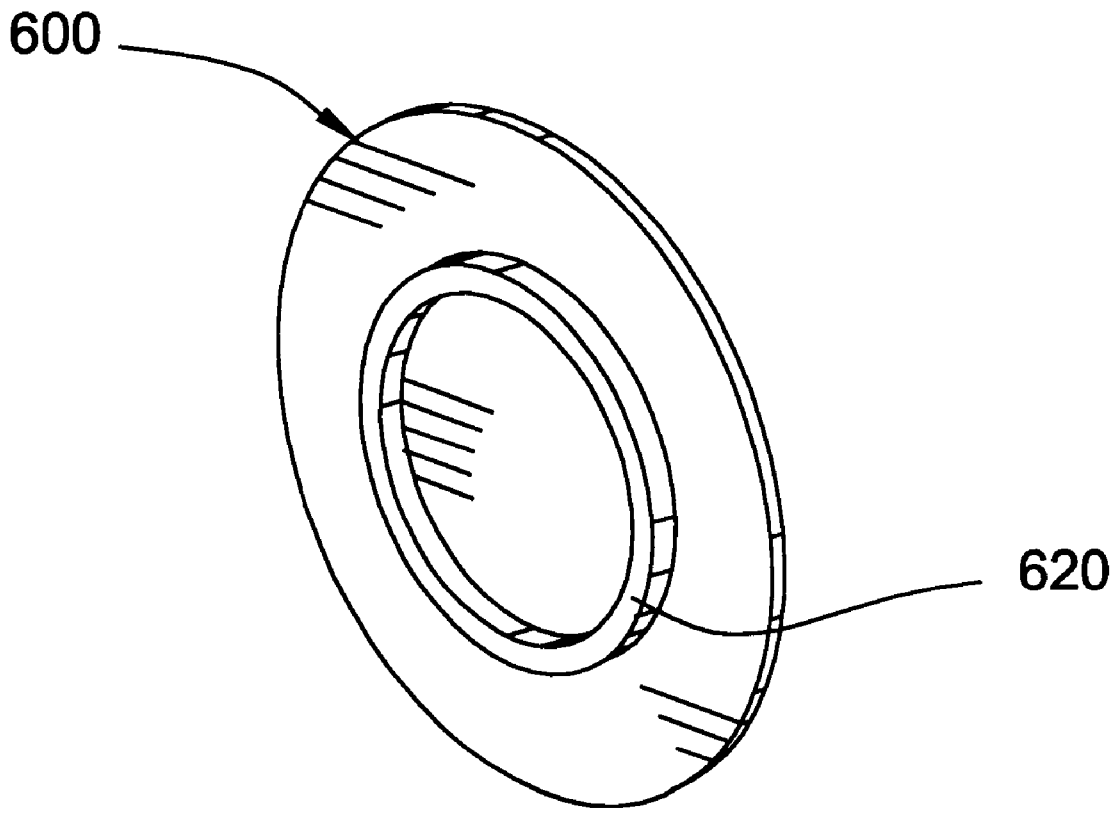
FIG. 7 is a perspective view of a preferred circular insert of the invention.

Bismuth beads having a diameter of about 0.2–0.4 mm shot are the preferred weighting agent although other materials described herein may be used (e.g., tungsten carbide beads). Adding weight to the projectile improves the accuracy and aerodynamic properties of the projectile. The weighting agent is added in an amount that achieves a center of gravity (Cg) of the projectile positioned forward of the center of pressure (Cp) for the projectile when fired, as shown in FIG. 6. The center of gravity, which refers to the distribution of mass in the projectile, can be defined as the point at which the projectile would be perfectly balanced if it were suspended with no forces, other than gravity, acting on it. The center of pressure can be defined as the point at which the projectile would be balanced if it were suspended with no forces, other than air pressure, acting on it. Preferably, the weighting agent is added such that the center of gravity is positioned as far forward as possible and is at least more forward than about 0.250 inches from the apex of the hemispherical portion. Also preferably, the distance X between the center of gravity and the center of pressure is approximately 0.125 inches.

Adding weight to the projectile can also enable the projectile to deliver a stunning blow causing a level of pain to the victim while the breakage characteristics of the projectile of the present invention generally inhibit entry of the projectile into the body as is possible with lethal bullets and supposedly non-lethal rubber bullets. Thus, the weighting agent also can act as an immobilizing component, either alone or in combination with the any other suitable immobilizing component. The total weight of the projectile, including the projectile shell (which weighs approximately 1 gram), the filling material, and any weighting agent added, is from about 3 g to about 16 g. Preferably, the total weight of the projectile is from about 3 g to about 8 g. It should be noted that a projectile having a total weight greater than about 8 g can potentially generate an impact which causes severe injury or even death. The amount of weighting agent added is calculated according to the size and weight of the projectile shell and the desired total weight of the projectile. Specifically, the amount of weighting agent added is that amount which, in combination with the filling material, has sufficient volume to fill the interior cavity and sufficient weight to produce the desired total weight of the projectile, taking into consideration the weight of the projectile shell.

As also noted above in the various embodiments, the cylindrical portion 3, the hollow frustum 205, 405 and the long hollow frustum 305, 505 each have an interior compartment 23 which may be filled through a fill hole 25, 225, 325. Generally, the interior compartment 23 may be filled with a marking composition. Typically, though not necessarily, the marking agent will be in a liquid form. Any suitable marking composition can be used. For example, the marking composition can be any suitable coloring agent. Suitable coloring agents can be liquid or powder dyes. One such suitable coloring agent is a water-soluble dye dispersed in water. Such a dye ultimately may be readily washed from the skin and clothing of a victim struck by the non-lethal projectile of the present invention. This permits the victim to remove the dye after apprehension. Another suitable coloring agent is a permanent dye. Other suitable coloring agents include dyes which can be detected by infra red or ultraviolet light. Still other suitable coloring agents include dyes that glow in the dark to permit detection of identified individuals who have been marked during day light hours (e.g., a chemiluminescent dye). In cases where the coloring agent is a chemical dye that is not compatible with the shell material, the coloring agent may be placed in miniature glass ampules, which are subsequently added to the interior compartment. The glass ampules are introduced into the cavity 23 of the cylindrical portion 3, the hollow frustum 205, 405 and the long hollow frustum 305, 505 prior to the joining of the hemispherical and cylindrical or frustum portions.

Alternatively or additionally, the interior compartment 23 of the invention may be filled with an immobilizing component, such as an irritant or other noxious chemical. The irritant or noxious chemical can be in a liquid, powder, or a gaseous state. Suitable irritants include eye irritants, such as pepper powder or tear gas. Suitable noxious agents include such chemicals as malodorants, which induce nausea and/or vomiting and other immobilizing components described herein. As discussed above, any immobilizing component not compatible with the shell material may be placed in miniature glass ampules that are subsequently added to the interior compartment.

The cavity 7 is preferably filled by inserting an injection needle into the fill hole 15 and the coloring agent, such as a vegetable dye dissolved in water, is injected into the cavity 7. After withdrawing the injection needle, a heat needle is applied to the fill hole 15 thus sealing the hemispherical portion 3. This seal is best effected when the resulting seal thickness is identical to the general thickness of the hemispherical portion 3. Likewise, the interior compartment 23 is filled by inserting an injection needle into the fill hole 25 and the coloring agent, such as a vegetable dye dissolved in water, is injected into the interior compartment 23. After withdrawing the injection needle from each fill hole, a heat needle is applied thus sealing the fill hole. Especially for the hemispherical portion 3, this seal is best effected when the resulting seal thickness is identical to the general thickness of the hemispherical portion 3.

Any flashing caused by the joining of the first portion 15 to the second portion 17 and the sealing of the fill port 35 is preferably removed from the filled and sealed ball.

When fired at a target such as a person, animal, or other target, the projectile of the present invention strikes the target. Samples of the various embodiments of the present invention were prepared and fired at standing targets. Example 1 was made according to the invention as seen in FIGS. 1*a* & 1*b*. Example 2 was made according to the invention as seen in FIGS. 2*a* & 2*b*. Example 3 was made according to the invention as seen in FIGS. 3*a* & 3*b*. Example 4 was made according to the invention as seen in FIGS. 4*a* & 4*b*. Example 5 was made according to the invention as seen in FIGS. 5*a* & 5*b*. When the examples of the present invention were made according to the invention and fired at stationary targets, the following results were obtained:

| Example | Accuracy | Efficiency | Controlled Spin | Oriented Flight |
|---|---|---|---|---|
| 1 | Bad | OK | No | No |
| 2 | OK | Good | No | No |
| 3 | OK | Good | No | Yes |
| 4 | Good | Good | Yes | Yes |
| 5 | Good | Good | Yes | Yes |

In the above chart, efficiency is defined as the volume of gas needed to bring the projectile to a desired velocity, with a higher velocity indicating better efficiency.

In the embodiments of the invention which achieve oriented flight (i.e. no tumbling of the projectile during flight), the target is first struck by the leading edge of the hemispheric portion 3. The ease of fracture of the hemispheric portion 3 results in easy marking of the victim. At the same time, the weight of the non-lethal projectile of the present invention stuns the victim causing the victim to either cease or reconsider its course of conduct.

All embodiments of the above-described invention apply to other embodiments unless otherwise stated or clearly contradicted by context. For example, description of the contents of, or modification made to, frustum portion-containing projectiles apply to cylinder portion-containing portion projectiles, and visa versa.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A projectile comprising:

(a) a shell comprising a hemispherical portion and a cylindrical portion, said hemispherical portion having an inner surface and an outer surface forming a wall and a hemispheric interior volume and a cylindrical portion having an inner surface and an outer surface forming a wall and an interior volume, wherein said cylindrical portion has a length which is at least about equal to one-half the diameter of said hemispherical portion, and wherein said hemispherical portion is joined to said cylindrical portion at a rim, (b) a marking component, immobilizing component, or both located within said interior volume of said hemispherical portion, said interior volume of said cylindrical portion, or both, and (c) a circular insert inside the shell.

2. The projectile of claim 1, wherein said interior volume of said hemispherical portion, said interior volume of said cylindrical portion, or both, comprises a chemiluminescent dye, a phosphorescent dye, or both.

3. The projectile of claim 1, wherein said interior volume of said hemispherical portion, said interior volume of said cylindrical portion, or both, comprise a weighting agent.

4. The projectile of claim 3, wherein said weighting agent has a specific gravity of about 1.5 g/cc to about 9.5 g/cc.

5. The projectile of claim 4, wherein said weighting agent comprises tungsten carbide, bismuth, lead, or a combination thereof.

6. The projectile of claim 5, wherein said projectile contains about 2 g to about 15 g of total weighting agent.

7. The projectile of claim 1, wherein said hemispheric interior volume and said cylindrical interior volume are separated by said circular insert.

8. The projectile of claim 7, wherein the contents of said hemispheric interior volume and said cylindrical interior volume are different.

9. The projectile of claim 1, further comprising scoring on or in the surface of the hemispherical portion, cylindrical portion, or both, which scoring promotes fracture at the surface locations comprising said scoring.

10. The projectile of claim 1, wherein said projectile lacks a centrally located indentation or depression.

11. The projectile of claim 1, wherein the width of said hemispherical portion wall, said cylindrical portion wall, and the width of the wall at the rim formed where said hemispherical portion wall and said cylindrical portion wall interact are about equal.

12. The projectile of claim 8, wherein at least a portion of the inner surface located in spaced relation to said rim has a diameter that is less than the diameter of said hemispherical portion measured at the rim and said cylindrical portion has a length which is at least one-half the diameter of said hemispherical portion.

13. The projectile of claim 1, further comprising a plurality of dimples which promote projectile accuracy, distance, or both.

14. A projectile comprising:

(a) a generally hemispherical portion and a frustum portion shell, said shell comprising a hemispherical portion having an inner surface and an outer surface which forms a wall and a hemispheric interior volume and a frustum portion having an inner surface and an outer surface which forms a wall and an interior volume, wherein said frustum portion has a diameter at its wide end which is about equal to the diameter of said hemispherical portion, and wherein said hemispherical portion is joined to said wide end of said frustum portion at a rim, (b) a marking component, immobilizing component, or both located within said interior volume of said hemispherical portion, said interior volume of said frustum portion, or both, and (c) a circular insert inside the shell.

15. The projectile of claim 14, wherein said interior volume of said hemispherical portion, said interior volume of said frustum portion, or both, comprises a chemiluminescent dye, a phosphorescent dye, or both.

16. The projectile of claim 14, wherein said interior volume of said hemispherical portion, said interior volume of said frustum portion, or both, comprise a weighting agent.

17. The projectile of claim 16, wherein said weighting agent has a specific gravity of about 1.5 g/cc to about 9.5 g/cc.

18. The projectile of claim 17, wherein said weighting agent comprises tungsten carbide, bismuth, lead, or a combination thereof.

19. The projectile of claim 18, wherein said weighting agent is added in an amount of from about 2 g to about 15 g.

20. The projectile of claim 14, wherein said hemispheric interior volume and said frustum interior volume are separated by said circular insert.

21. The projectile of claim 20, wherein the contents of said hemispheric interior volume and said frustum interior volume are different.

22. The projectile according to claim 14, further comprising scoring on or in the surface of the hemispherical portion, frustum portion, or both, which scoring promotes fracture at the surface locations comprising said scoring.

23. The projectile according to claim 14, wherein said projectile lacks a centrally located indentation or depression.

24. The projectile of claim 14, wherein the width of said hemispherical portion wall, said frustum portion wall, and the width of the wall at the rim formed where said hemispherical portion wall and said frustum portion wall interact are about equal.

25. The projectile of claim 14, wherein said frustum portion has a length which is at least about equal to one-half of its diameter.

26. The projectile according to claim 14, further comprising a plurality of dimples which promote projectile accuracy, distance, or both.

27. A method of producing a projectile having a hemispherical shell and a cylindrical shell comprising:

(a) injecting a linear polymer into a first mold, forming a hemispherical shell having a hemispheric inner wall, a hemispheric outer wall, an interior volume, and a fill port, said inner and outer walls forming a rim;

(b) injecting a linear polymer into a second mold, forming a cylindrical shell having a hemispheric inner wall, a cylindrical outer wall, an interior volume, and a fill port, said inner and outer walls forming a rim which mates with the profile of said hemispherical shell rim and which mated profile allows capture of a circular insert;

(c) forming a circular insert having a first wall which faces the interior volume of the hemispherical shell and a second wall which faces the interior volume of the cylindrical shell;

(d) placing said circular insert between said hemispherical shell and said cylindrical shell;

(e) joining said hemispherical shell, said cylindrical shell, and said circular insert together along said hemispherical shell rim and said cylindrical shell rim, forming a projectile shell wherein said interior volume of said hemispherical shell is isolated from said interior volume of said cylindrical shell;

(f) dispensing into said projectile shell through said hemispherical fill port, said cylindrical fill port, or both a marking composition, immobilizing agent, or both; and (g) sealing said hemispherical fill port, cylindrical fill port, or both, as applicable.

28. The method of claim 27, wherein said method comprises (1) dispensing a weighting agent into said hemispherical interior volume, said cylindrical interior volume, or both interior volumes, before joining said cylindrical shell and said hemispherical shell, (2) dispensing a weighting agent into said hemispheric interior volume through said hemispheric fill port, dispensing a weighting agent into said cylindrical interior volume through said cylindrical fill port, or both, or (3) dispensing a weighting agent in said interior volumes through any combination of the steps of (1) and (2).

29. A method of producing a projectile having a hemispherical shell and a frustum shell comprising:

(a) injecting a linear polymer into a first mold, forming a hemispherical shell having a hemispheric inner wall, a hemispheric outer wall, an interior volume, and a fill port, said inner and outer walls forming a rim;

(b) injecting a linear polymer into a second mold, forming a frustum shell having a hemispheric inner wall, a frustum outer wall, an interior volume, and a fill port, said inner and outer walls forming a rim which mates with the profile of said hemispherical shell rim and which mated profile allows capture of a circular insert;

(c) forming a circular insert having a first wall which faces the interior volume of the hemispherical shell and a second wall which faces the interior volume of the frustum shell;

(d) placing said circular insert between said hemispherical shell and said frustum shell;

(e) joining said hemispherical shell, said frustum shell, and said circular insert together along said hemispherical shell rim and said frustum shell rim, forming a projectile shell wherein said interior volume of said hemispherical shell is isolated from said interior volume of said frustum shell;

(f) dispensing into said projectile shell through said hemispherical fill port, said cylindrical fill port, or both, a marking composition, an immobilizing agent, or both, and (g) sealing said hemispherical fill port, said cylindrical fill port, or both, as applicable.

30. The method of claim 29, wherein said method comprises (1) dispensing a weighting agent into said hemispherical interior volume, said frustum interior volume, or both interior volumes, before joining said frustum shell and said hemispherical shell, (2) dispensing a weighting agent into said hemispheric interior volume through said hemispheric fill port, dispensing a weighting agent into said frustum interior volume through said frustum fill port, or both, or (3) dispensing a weighting agent in said interior volumes through any combination of the steps of (1) and (2).

* * * * *